US006282757B1

(12) United States Patent
Buck

(10) Patent No.: US 6,282,757 B1
(45) Date of Patent: Sep. 4, 2001

(54) FLEXIBLE CLOSURE

(76) Inventor: Jennifer Ellen Buck, P.O. Box 671, Mantoloking, NJ (US) 08738

( * ) Notice: Subject to any disclaimer, the term of this patent is extended or adjusted under 35 U.S.C. 154(b) by 0 days.

(21) Appl. No.: 09/417,183

(22) Filed: Oct. 12, 1999

Related U.S. Application Data

(60) Provisional application No. 60/104,171, filed on Oct. 13, 1998.

(51) Int. Cl.[7] ..... B65D 63/00; B65D 77/10

(52) U.S. Cl. ..... 24/30.5 R; 24/16 R; 24/30.5 S; 24/546

(58) Field of Search ..... 24/30.5 R, 30.5 S, 24/30.5 T, 16 R, 546; 383/34

(56) References Cited

U.S. PATENT DOCUMENTS

| | | | |
|---|---|---|---|
| 91,075 | | 6/1869 | Borst et al. . |
| 1,111,091 | | 9/1914 | Pauli . |
| 1,338,375 | | 4/1920 | Kleidman . |
| 2,084,757 | | 6/1937 | Alter . |
| 2,227,390 | | 12/1940 | Green . |
| 2,325,853 | | 8/1943 | Harlem . |
| 2,695,647 | | 11/1954 | Deutsch . |
| 3,259,302 | * | 7/1966 | Rocchisani ..... 24/30.5 R |
| 3,996,937 | * | 12/1976 | Williams ..... 24/546 |
| 4,660,558 | * | 4/1987 | Kees, Jr. ..... 24/546 |
| 5,524,990 | | 6/1996 | Buck . |

OTHER PUBLICATIONS

"dry bag" with top that rolls to seal marketed by West Marine, no date is given.

* cited by examiner

*Primary Examiner*—Victor N. Sakran

(57) ABSTRACT

A flexible closure capable of closing a flexible opening. The closure is comprised of two or more strip-like elements that are oriented in a parallel series and have ends that are attached together. The strip-like elements are alternately deformed in groups of one or more to one side and then the other side of a flexible opening. The sets of groups on the two opposing sides of the opening are brought together and held together with a force, usually to create a seal. The closure may be closed in a variety of positions, including curved and straight. The flexible opening being acted upon may be attached permanently inside or outside the closure, attached removably inside or outside the closure, the closure may be placed around the flexible opening, or the closure may be incorporated into the flexible opening. The closure may be used to close such entities as flexible containers.

20 Claims, 23 Drawing Sheets

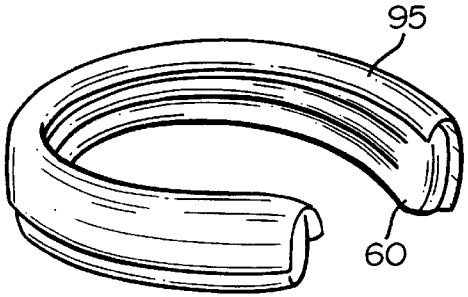
FIG. 32
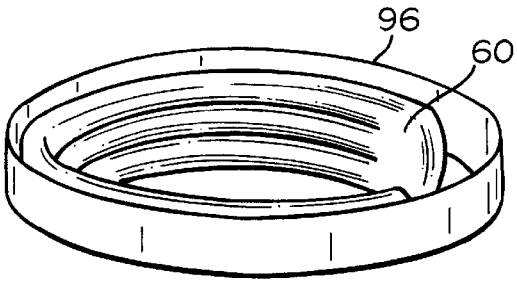
FIG. 33
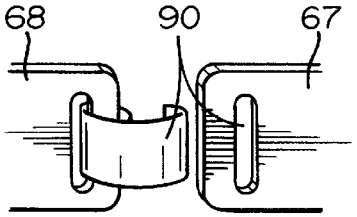
FIG. 27
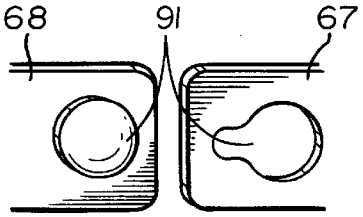
FIG. 28
FIG. 29
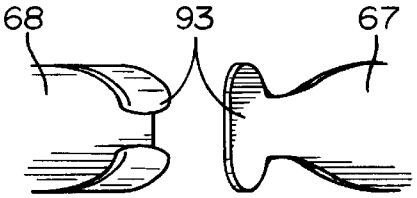
FIG. 30
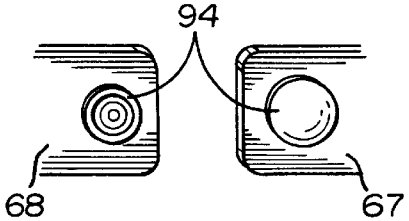
FIG. 31

FLEXIBLE CLOSURE

This Appln claims benefit of Provisional No. 60/104,171 filed Oct. 13, 1998.

FIELD OF THE INVENTION

This invention relates to flexible closures for flexible openings, particularly flexible reusable closures.

BACKGROUND OF THE INVENTION

Flexible containers as disclosed in my U.S. Pat. No. 5,524,990 have the potential to replace plastic bags and hard sided containers commonly used for storing food and other miscellaneous goods in many applications. However, these flexible containers rely on the ability of the material at the hinged corners to stand up to constant use for their closure's ability to open and close repeatedly. This need for wearability limits the materials that may be used. Additionally, the containers need not only to stand up to constant use but also to be able to seal tightly at these corners, in other words needing strength for wear and flexibility for seal. This again limits the materials that are appropriate.

SUMMARY OF THE INVENTION

The present invention is concerned with providing a flexible container closure which can withstand long-term use and which can be designed to clamp as tightly or as loosely as desired in specific regions or along the entire length of the closure or specifically at the corners, and may be made from a variety of different materials.

In general, the present invention provides a closure either attached to or attachable to or able to be incorporated into or able to be placed around a flexible opening or region on a flexible entity such as a container, surface, tube or sleeve, where the closure is comprised of a part that is stiffened to some degree around the opening of the entity. Unlike the prior referenced patented container, the closure of the present invention advantageously relies largely on the flexibility of the closure in the larger region near the corners of the closure for most of its movement during opening and closing instead of strictly on a hinged connection that forms the corner.

According to a particular aspect of the present invention there is provided a flexible closure capable of closing a flexible opening, comprising at least two strip-like elements having ends. The strip-like elements are oriented in a parallel series and attached together at the ends. The strip-like elements are alternately deformed in groups of at least one to one side then to the other side of the flexible opening to close it. The groups of strip-like elements form two sets, one of the sets on each of two sides of an area to be closed. The two sets are positioned away from each other when the area to be closed is open, and they are positioned against each other when the area to be closed is closed.

The closure may be formed in all one piece. The closure may be permanently attached, removably attached, or placed around the flexible opening. The closure may also be incorporated into the flexible opening. One or more of the strip-like elements of the closure may possess at one or more region that is stiffened. A section of the flexible opening being closed by the closure may be kept open while the remainder of the flexible opening is closed. Additionally, a closure may close more than one flexible openings. Also, the strip-like elements of the closure may be lined up both vertically and horizontally to form a three dimensional structure.

According to another aspect of the present invention, there is provided a flexible closure comprising a series of at least two flexible stiffening flanges that are lined up like rungs on a ladder. The rung-like flexible stiffening flanges are attached at two ends by two attachment regions that are perpendicular to the rung-like flexible stiffening flanges, and appear like sides of a ladder that support rungs of a ladder. The rung-like flexible stiffening flanges and attachment regions thereby form a ladder-like structure. This ladder-like structure is oriented in a vertical manner and the rung-like flexible stiffening flanges move horizontally in groups of at least one away from the centerline of the ladder-like structure to form an opening. The groups of rung-like flexible stiffening flanges form two sets on opposing sides of the opening, and the sets of groups of rung-like flexible stiffening flanges move towards each other to close the closure.

The sets on the two opposing sides of the closure may be held together by an internal force within one or more of the flexible stiffening flanges. A container may incorporate the closure. The two sets on the two opposing sides may be held together by an external force pressing from the outside of the opposing sides. The means by which the closure is held closed may be separate from the closure. The force holding the sets on opposing sides together may be created by the closure being deformed and held in a curved manner. The closure may be maintained in a curved manner by a releasably attached attachment connecting the two ends. The flexible stiffening flanges of the closure on the outer of the two sides when the closure is deformed and held in a curved manner may be made up of the material comprising a flexible opening being closed. One or more of the flexible stiffening flanges of the closure, at least one of said two flexible stiffening flanges from each of said two sets, may overlap in a vertical manner.

According to yet another aspect of the present invention there is provided a closure comprising a series of at least two flexible bar-like portions that are oriented in groups of at least one to one side then to the other side of an opening between them. The groups comprise two sides of said opening that is oval, circular or eye shaped when opened. The two sides move towards each other as the opening closes. The flexible bar-like portions have ends connected together and comprising a hingeline having two corners that coincide with the ends of the flexible bar-like portions making up the groups comprising the two sides of the opening. The sides nest against each other when the closure is closed.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings, in which in different Figures like reference characters indicate like parts.

Figure 2A:
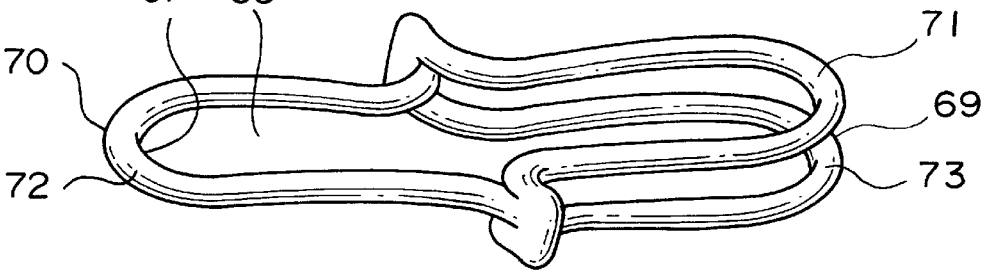
FIG. 2*a* is a diagrammatic side perspective view of one method of opening and closing the closure illustrated in FIG.
Figure 2B:
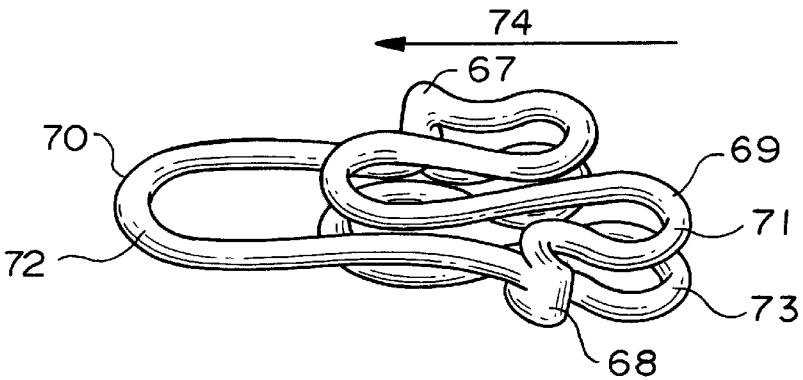
Figure 2C:
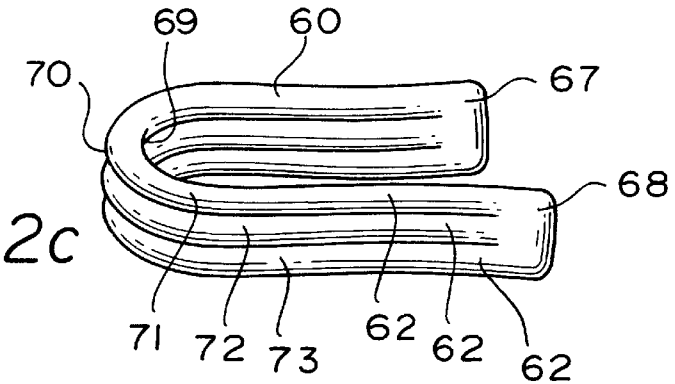
Figure 3A:
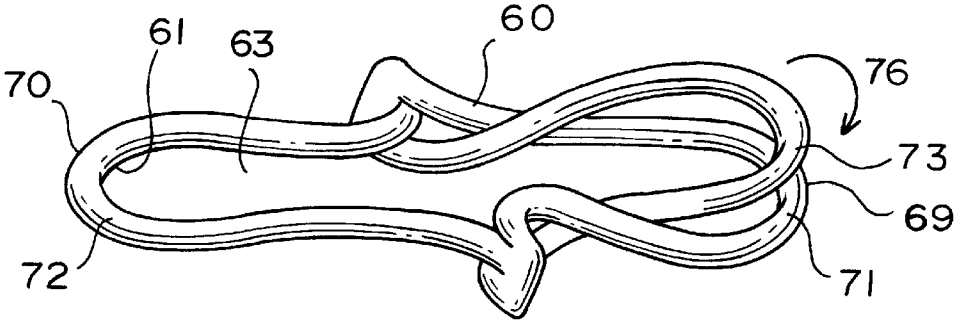
Figure 3B:
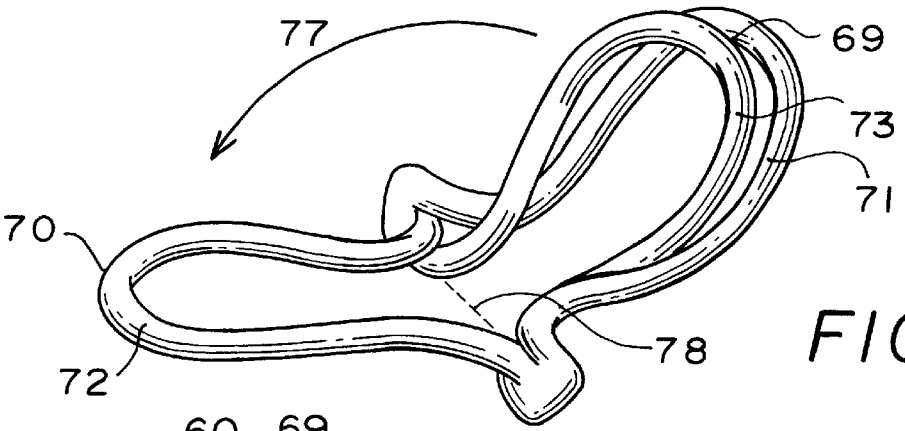
Figure 3C:
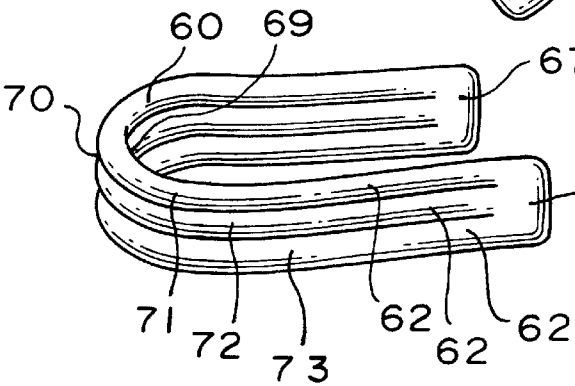
Figure 4A:
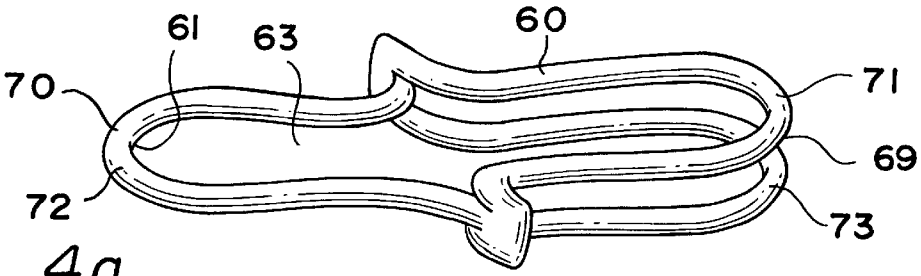
Figure 4B:
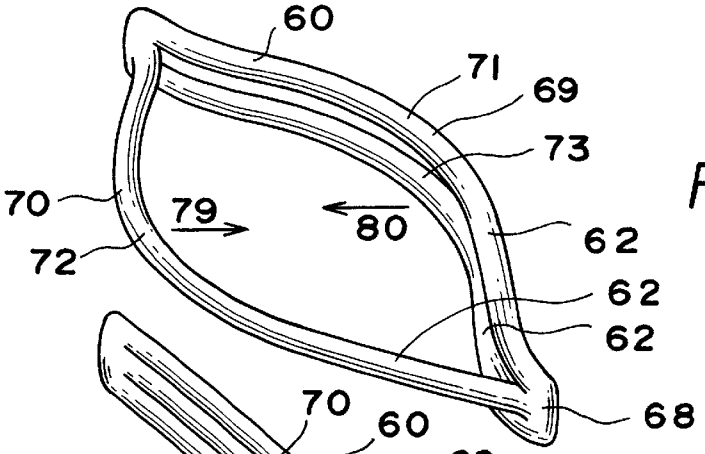
Figure 4C:
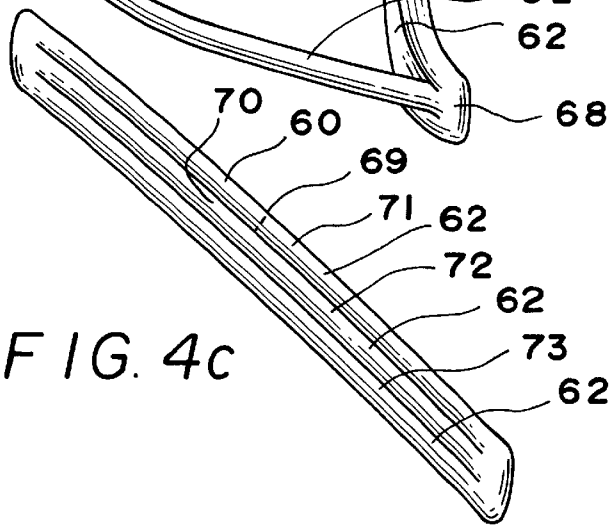
Figure 5:
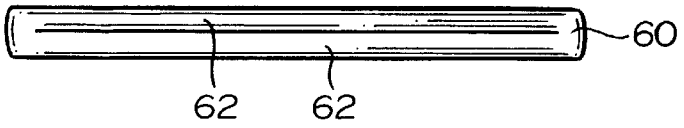
Figure 6:
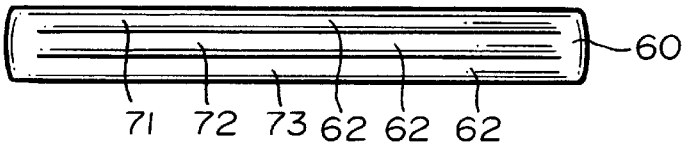

1*a* to 1*f* according to the present invention, not including a flexible opening being acted upon;

FIG. 2*b* is a diagrammatic side perspective view of the closure of FIG. 2*a* partially closed, with an arrow showing the direction of closure of the right side to the left side;

FIG. 2*c* is a diagrammatic side perspective view of the closure of FIG. 2*a* in a substantially closed position;

FIG. 3*a* is a diagrammatic side perspective view of another way to open and close the closure illustrated in FIG. 1*a* to 1*f*, not including a flexible opening being acted upon, differing from FIG. 2*a* in the 180 degree rotation of the right side and the twist of the strip-like elements;

FIG. 3*b* is a diagrammatic side perspective view of the closure of FIG. 3*a* partially closed, with an arrow showing the direction of closure of the right side to the left side;

FIG. 3*c* is a diagrammatic side perspective view of the closure of FIG. 3*a* in a substantially closed position;

FIG. 4*a* is a diagrammatic side perspective view of a further way to open and close the closure illustrated in FIG. 1*a* to 1*f*, not including a flexible opening being acted upon;

FIG. 4*b* is a diagrammatic side perspective view of the closure of FIG. 4*a* partially closed, with an arrows showing the direction of closure of the two sides;

FIG. 4*c* is a diagrammatic side perspective view of the closure of FIG. 4*a* in a substantially closed position;

FIG. 5 is a diagrammatic front perspective of another closure according to the present invention with two strip-like elements;

FIG. 6 is a diagrammatic front view of a closure according to the present invention with three strip-like elements, as illustrated in FIG. 1*a* to 4*c;*

Figure 7:
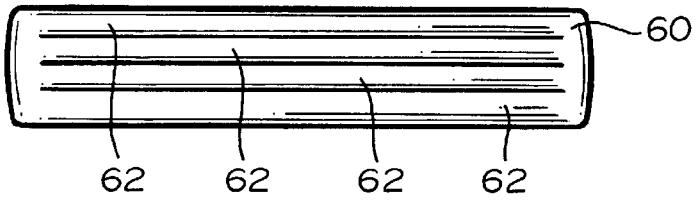
Figure 8:
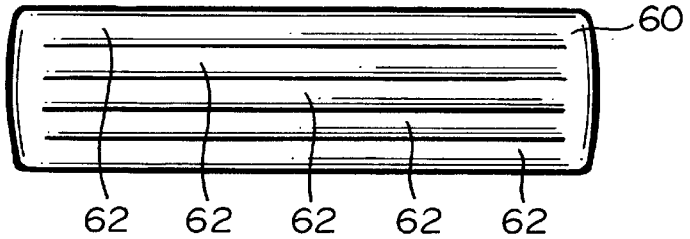
Figure 9:
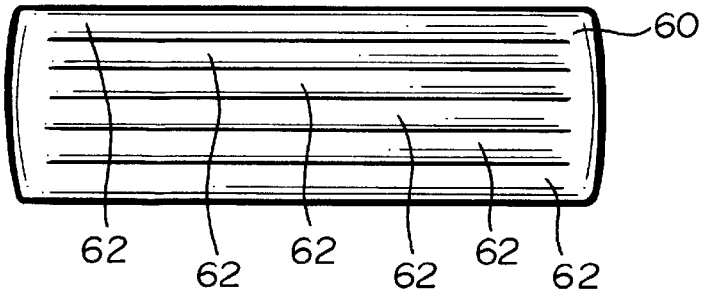
Figure 10A:
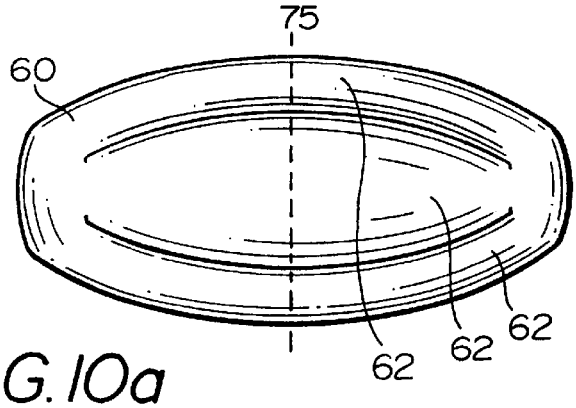
Figure 10B:
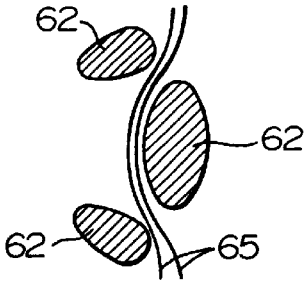
Figure 11A:
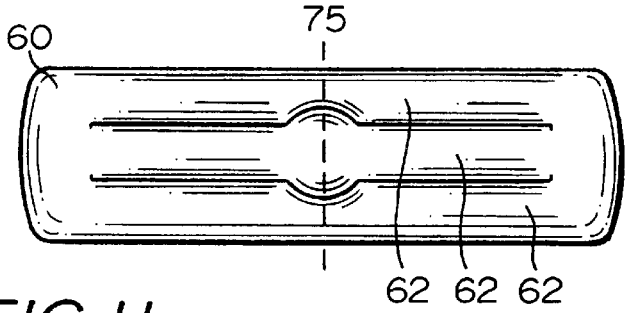
Figure 11B:
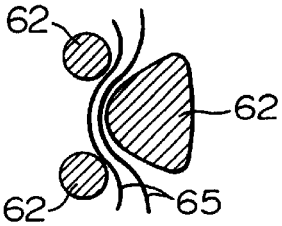
Figure 12A:
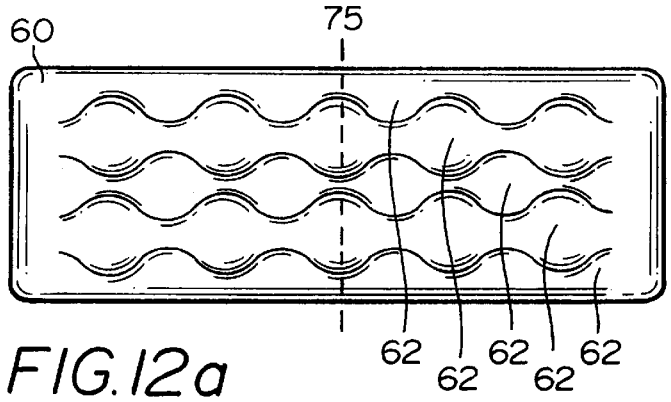
Figure 13A:
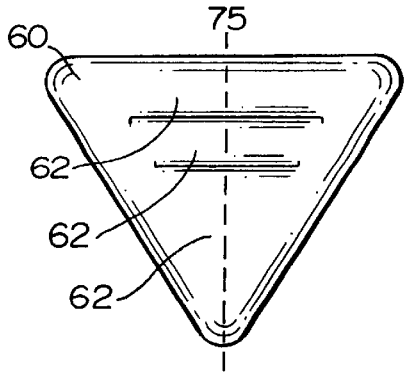
Figure 12B:
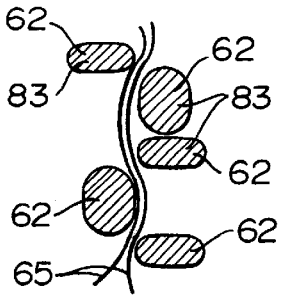
Figure 12C:
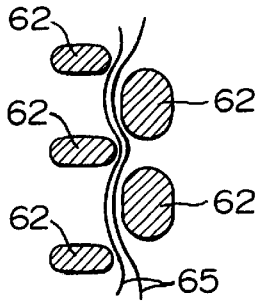
Figure 13B:
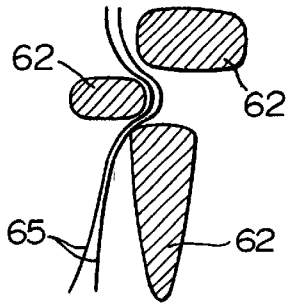
Figures 14A, 14B, 14C:
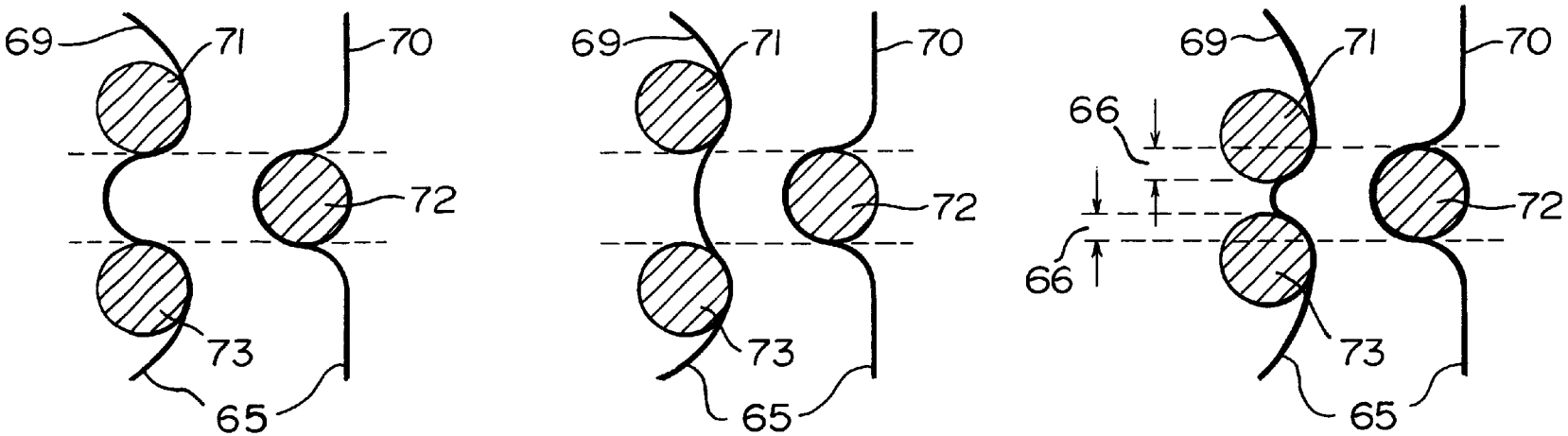
Figure 15A:
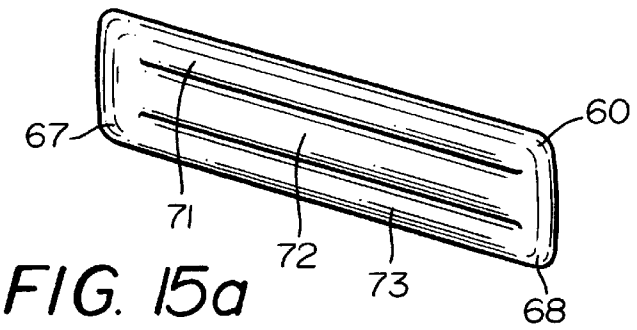
Figure 15B:
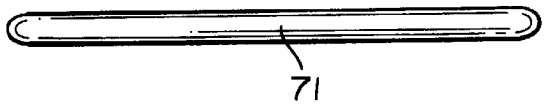
Figure 15C:
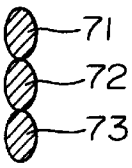
Figure 16A:
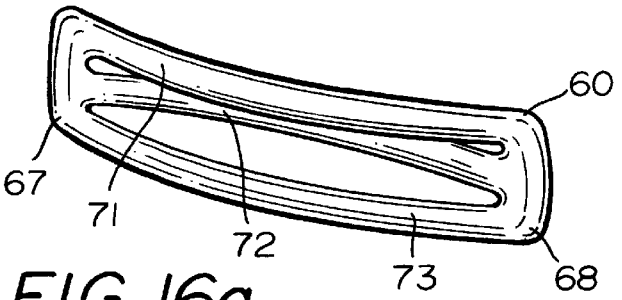
Figure 16B:
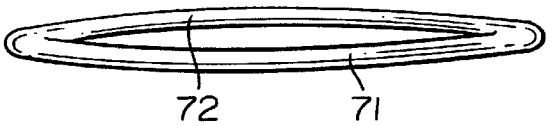
Figure 16C:
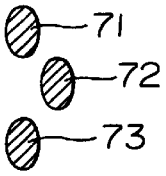
Figure 17A:
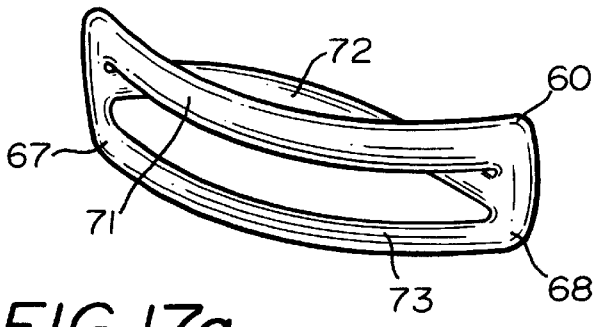
Figure 17B:
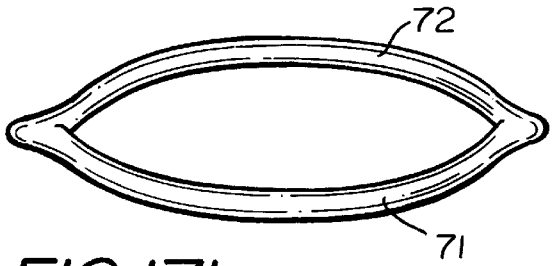
Figure 17C:
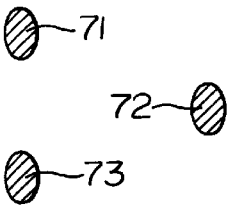
Figure 18A:
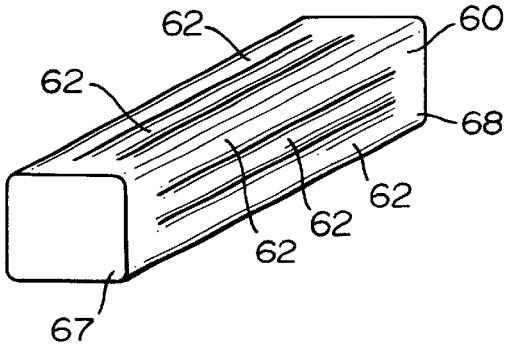
Figure 18B:
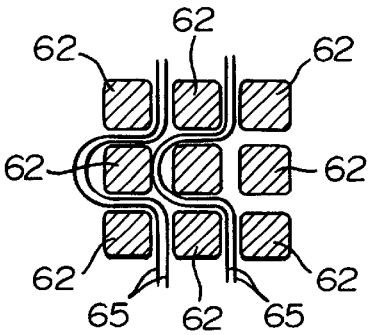

FIG. 7 is a diagrammatic front view of another closure according to the present invention with four strip-like elements;

FIG. 8 is a diagrammatic front view of another closure according to the present invention with five strip-like elements;

FIG. 9 is a diagrammatic front view of yet another closure according to the present invention with six strip-like elements;

FIG. 10*a* to 13*b* illustrate additional embodiments of closures according to the present invention showing differences in shape, size and placement of strip-like elements of a closure;

FIG. 14*a* to 14*c* illustrate various configurations for placement of strip-like elements and the flexible material of the closure FIG. 15*a*, 16*a* and 17*a* are diagrammatic side perspective views additional embodiments of closures according to the present invention showing possible differences in the position of the strip-like elements in the rest position, all appearing as illustrated in FIG. 6 from the front view;

FIG. 15*b*, 16*b* and 17*b* are diagrammatic top perspective views of the closures shown in FIG. 15*a*, 16*a* and 17*a* showing the relative positioning of the strip-like elements;

FIG. 15*c*, 16*c* and 17*c* are crosssection views of the center of the closures shown in FIG. 15*a*, 16*a* and 17*a* showing the relative positioning of the strip-like elements;

FIG. 18*a* illustrates a perspective view of another embodiment of a closure according to the present invention with strip-like elements appearing both from top to bottom and from side to side;

FIG. 18*b* is a crosssection view of FIG. 18*a;*

Figure 19A:
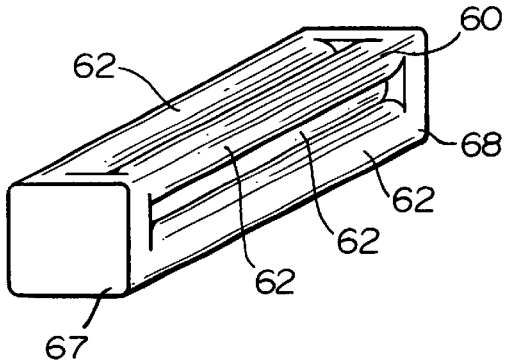
Figure 19B:
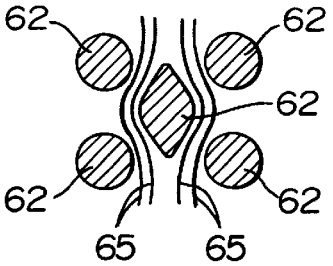

FIG. 19*a* illustrates a perspective view of another embodiment of a closure according to the present invention with strip-like elements appearing both from top to bottom and from side to side;

FIG. 19*b* is a crosssection view of FIG. 19*a;*

Figure 20A:
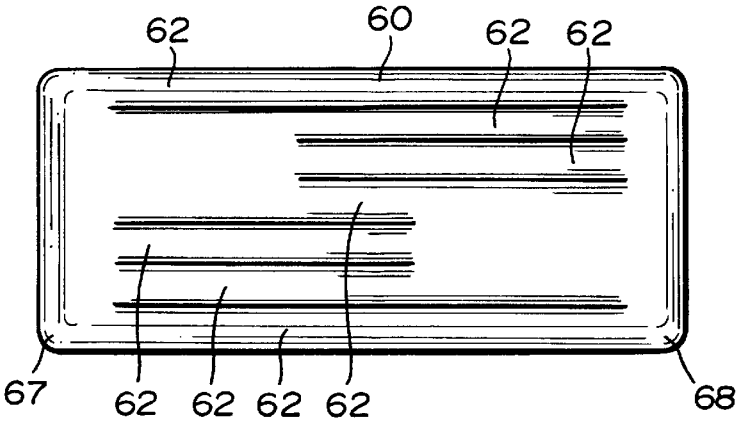
Figure 20B:
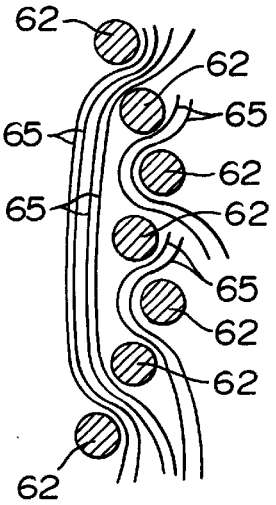

FIG. 20*a* illustrates a perspective view of another embodiment of a closure according to the present invention with strip-like elements affecting multiple flexible openings;

FIG. 20*b* is a crosssection view of FIG. 20*a;*

Figure 21B:
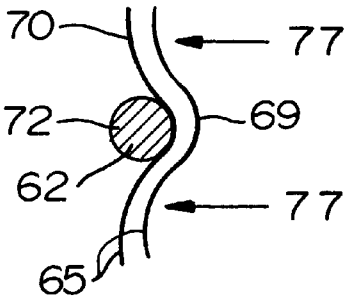
Figure 21A:
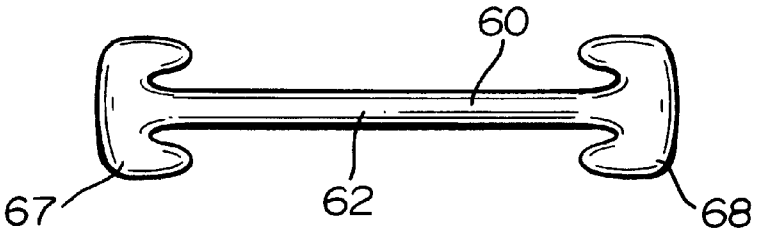

FIG. 21*a* illustrates front view of another embodiment of a closure according to the present invention with the flexible opening material being closed acting as continuations of strip-like elements;

FIG. 21*b* is a crosssection view of FIG. 21*a;*

Figure 22B:
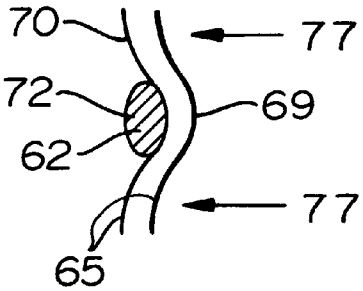
Figure 22A:
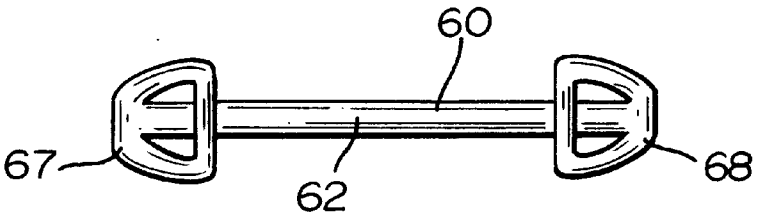
Figure 24:
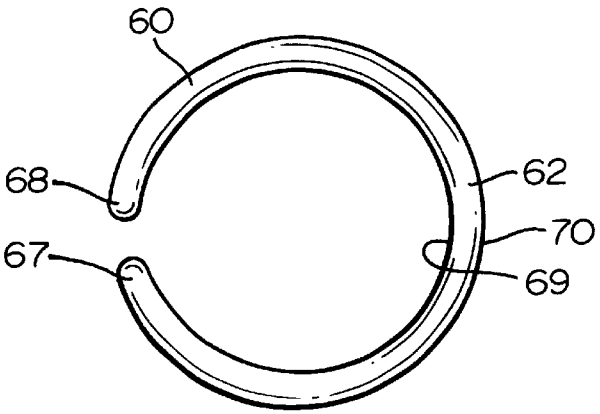
Figure 26:
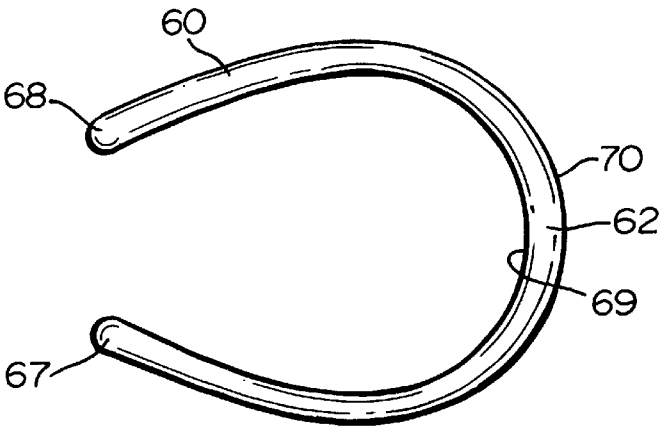
Figure 23:
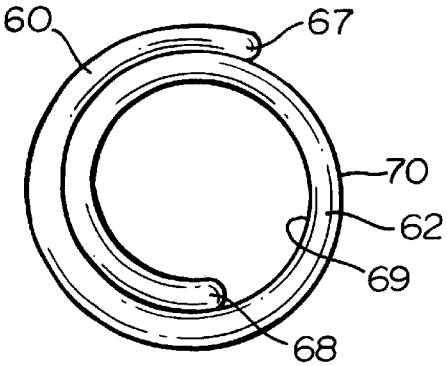
Figure 25:
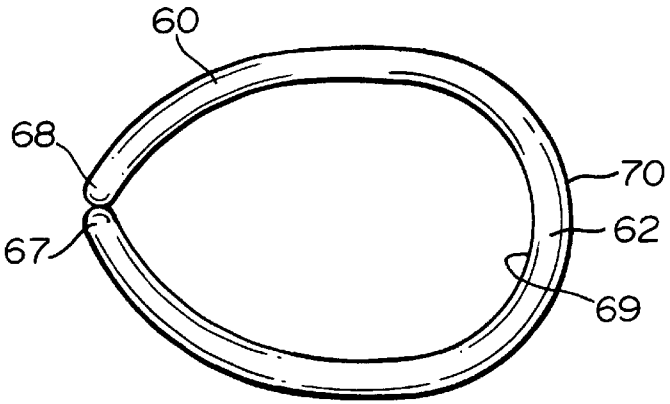

FIG. 22*a* illustrates front view of yet another embodiment of a closure according to the present invention with the flexible member being closed acting as continuations of portions of the strip-like elements;

FIG. 22*b* is a crosssection view of FIG. 22*a;*

Figure 34B:
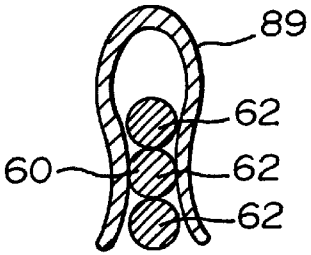
Figure 34A:
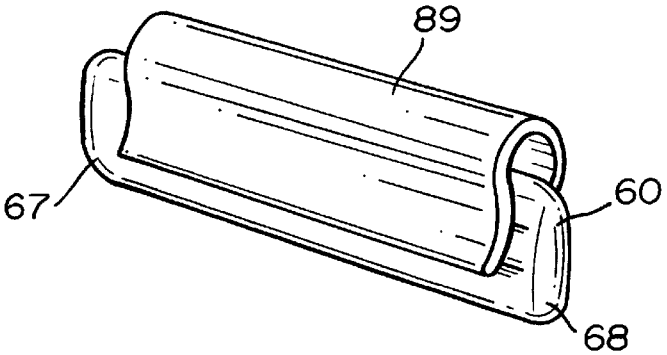

FIG. 23 to 26 are diagrammatic top views of closures according to the invention being tightened by bending or curving the closure;

FIG. 27 to 31 illustrate methods of attaching two ends of a closure together to hold a closure in a bent or curved position that could be used to keep a closure that needs to be held bent in its position;

FIG. 32 to 33 illustrate frames that may be placed over and or around a closure that could be used to keep the closure that needs to be held bent in its position;

FIG. 34*a* is a diagrammatic side perspective view of a closure closed by an external force pressing from the outer area around the two sides of the closure to hold it closed;

FIG. 34*b* is a crosssection view of the closure in FIG. 34*a;*

Figure 36:
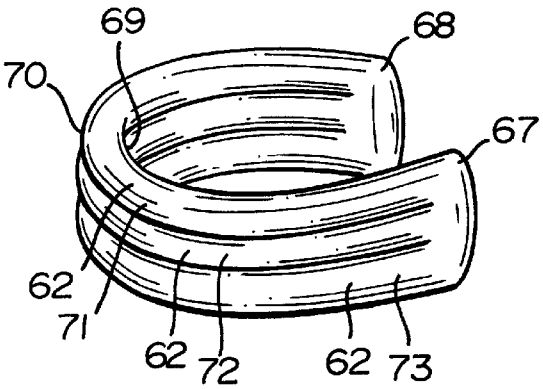
Figure 35:
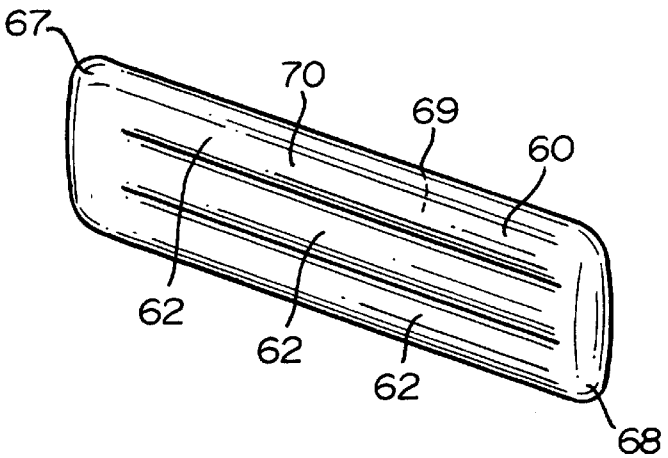
Figure 37A:
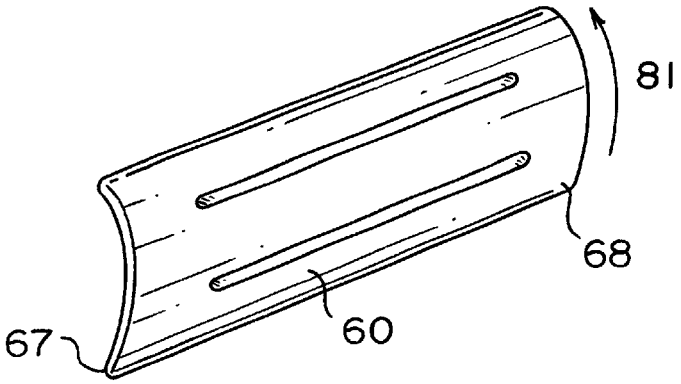
Figure 37B:
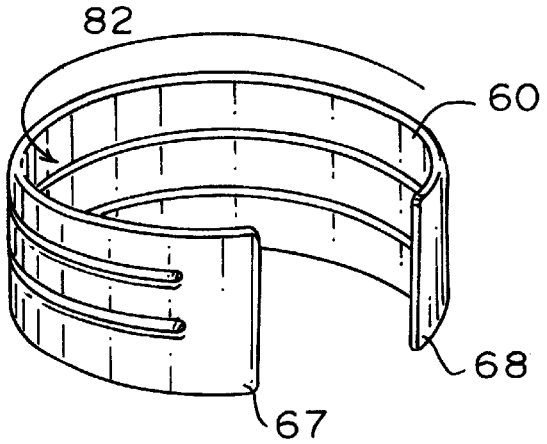
Figure 37C:
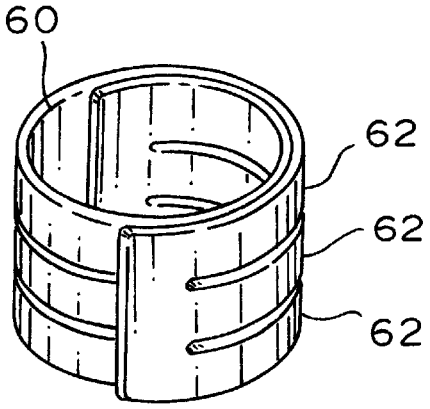
Figure 37D:
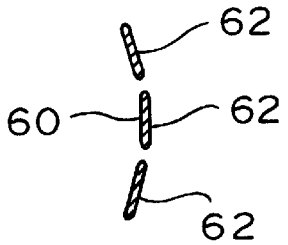

FIG. 35 is a diagrammatic side perspective view of a closure that is held closed by internal force by way of strip-like elements that have a force causing one of more of them to become straight;

FIG. 36 is a diagrammatic side perspective view of a closure closed by internal force by way of strip-like elements that have a force causing one or more of them to become bended or curved;

FIG. 37*a* illustrates another embodiment of a closure according to the present invention made of a material with inherent residual stresses that has two stable positions, the first illustrated here;

FIG. 37*b* illustrates the closure of FIG. 37*a* moving towards its second stable position;

FIG. 37*c* illustrates the closure of FIG. 37*a* in its second stable position;

FIG. 37*d* illustrates a crosssection view of FIG. 37*a;*

Figure 38:
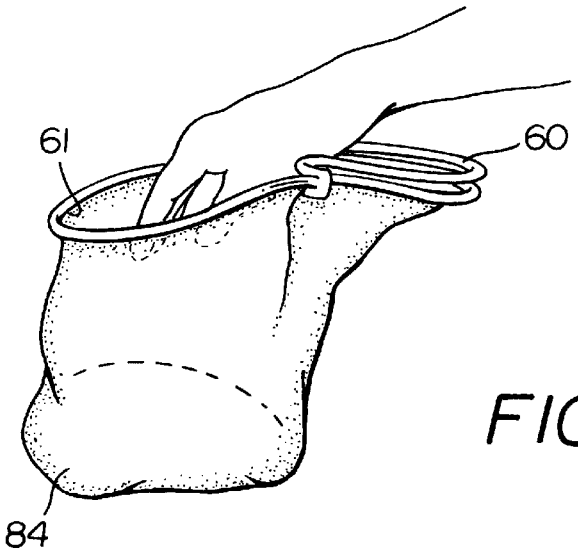
Figure 39:
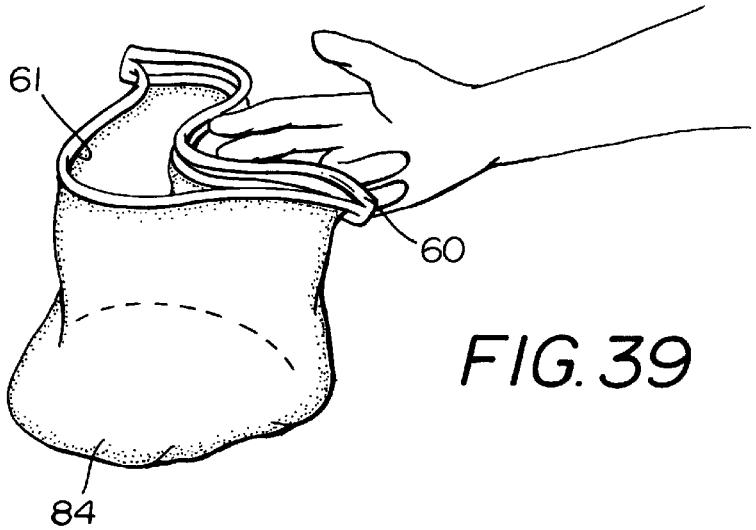
Figure 40:
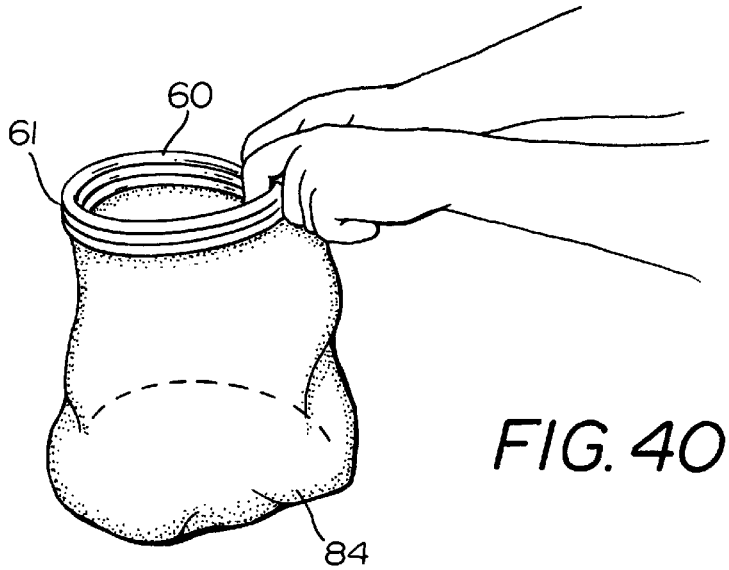
Figure 41:
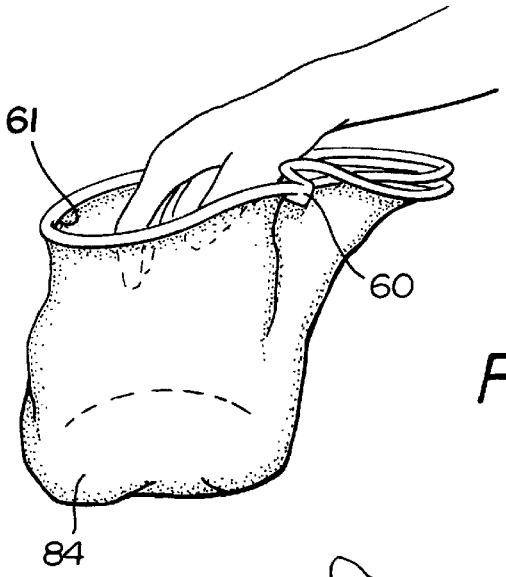
Figure 42:
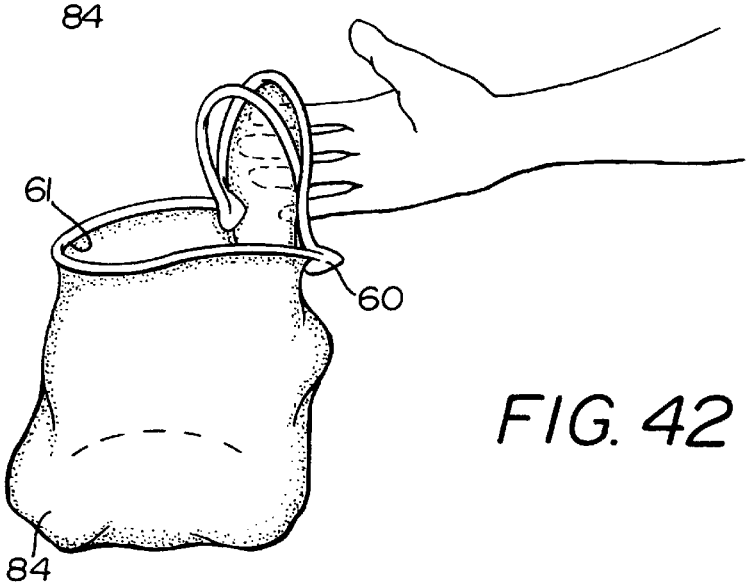
Figure 43:
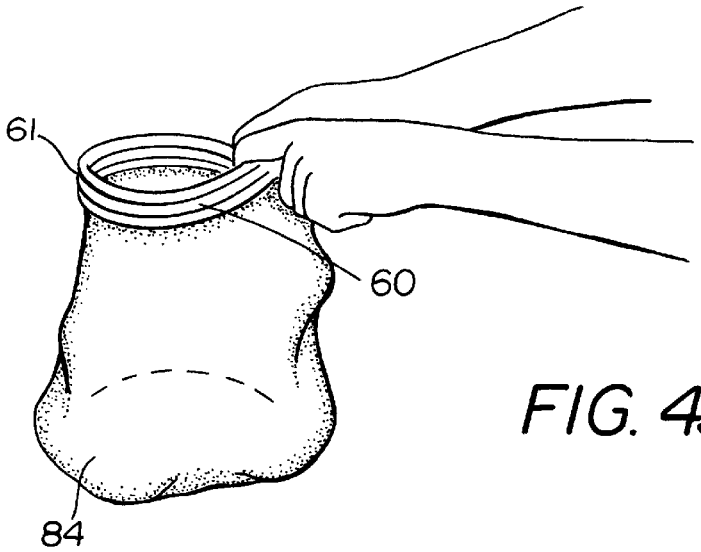
Figure 44:
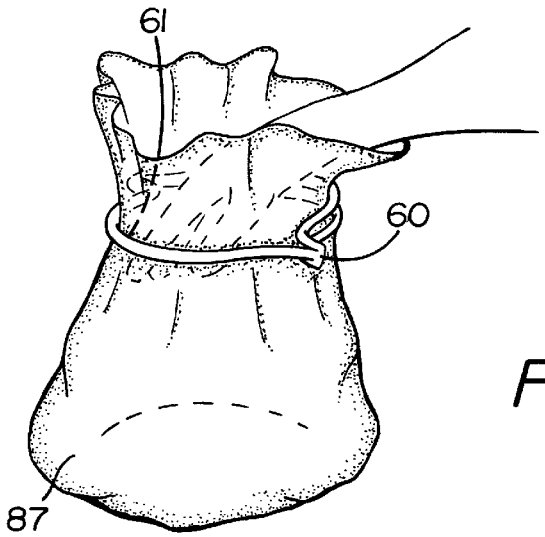
Figure 45:
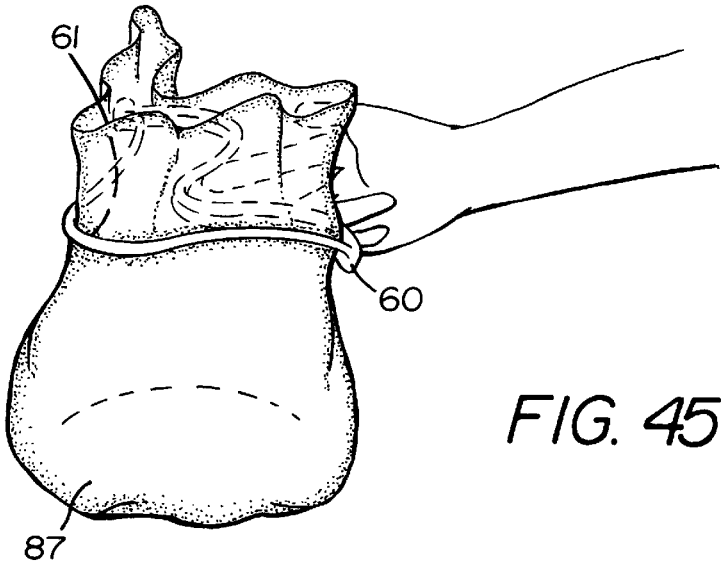
Figure 46:
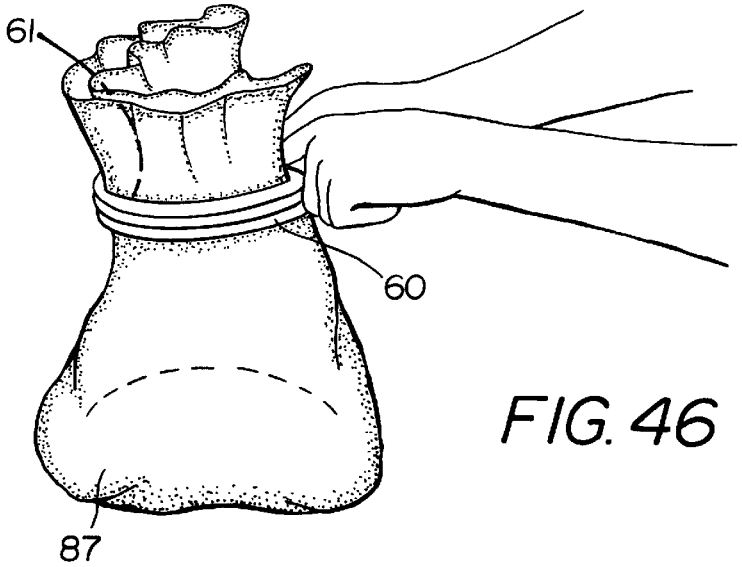
Figures 47, 48, 49, 50:
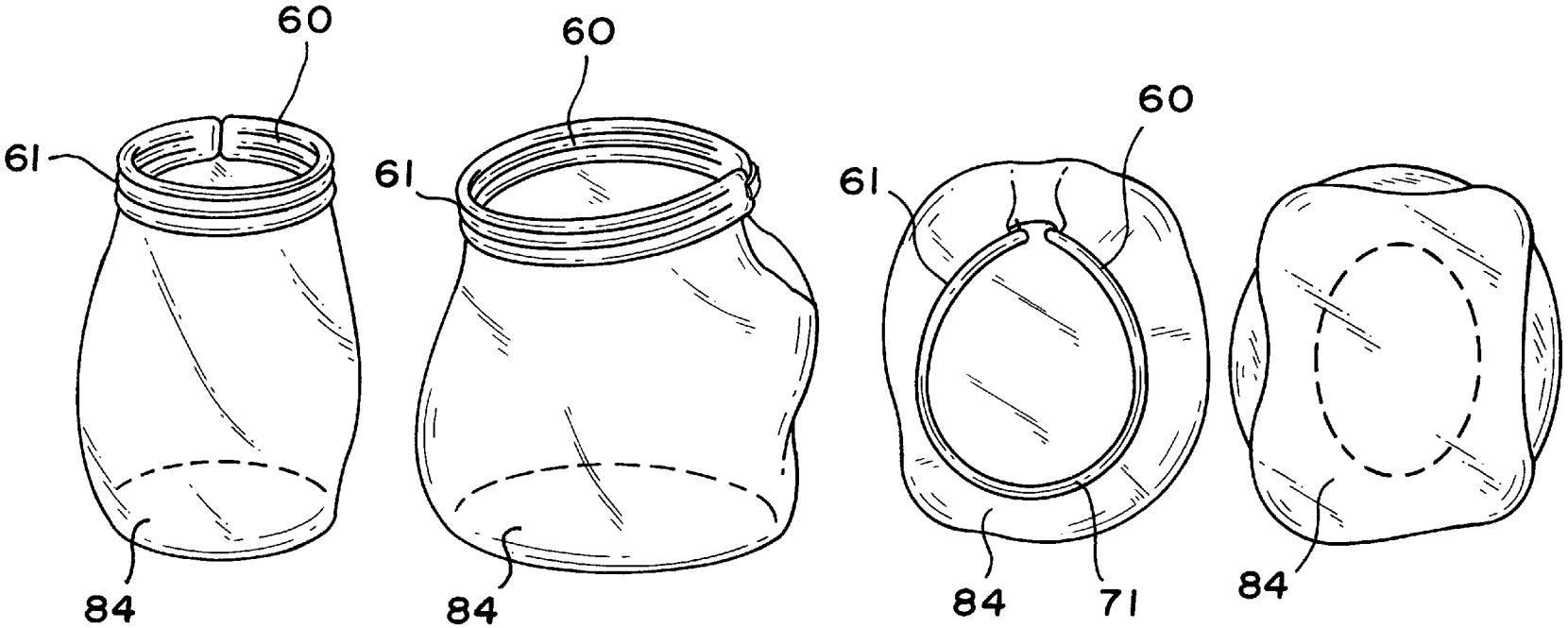
Figures 51, 52, 53:
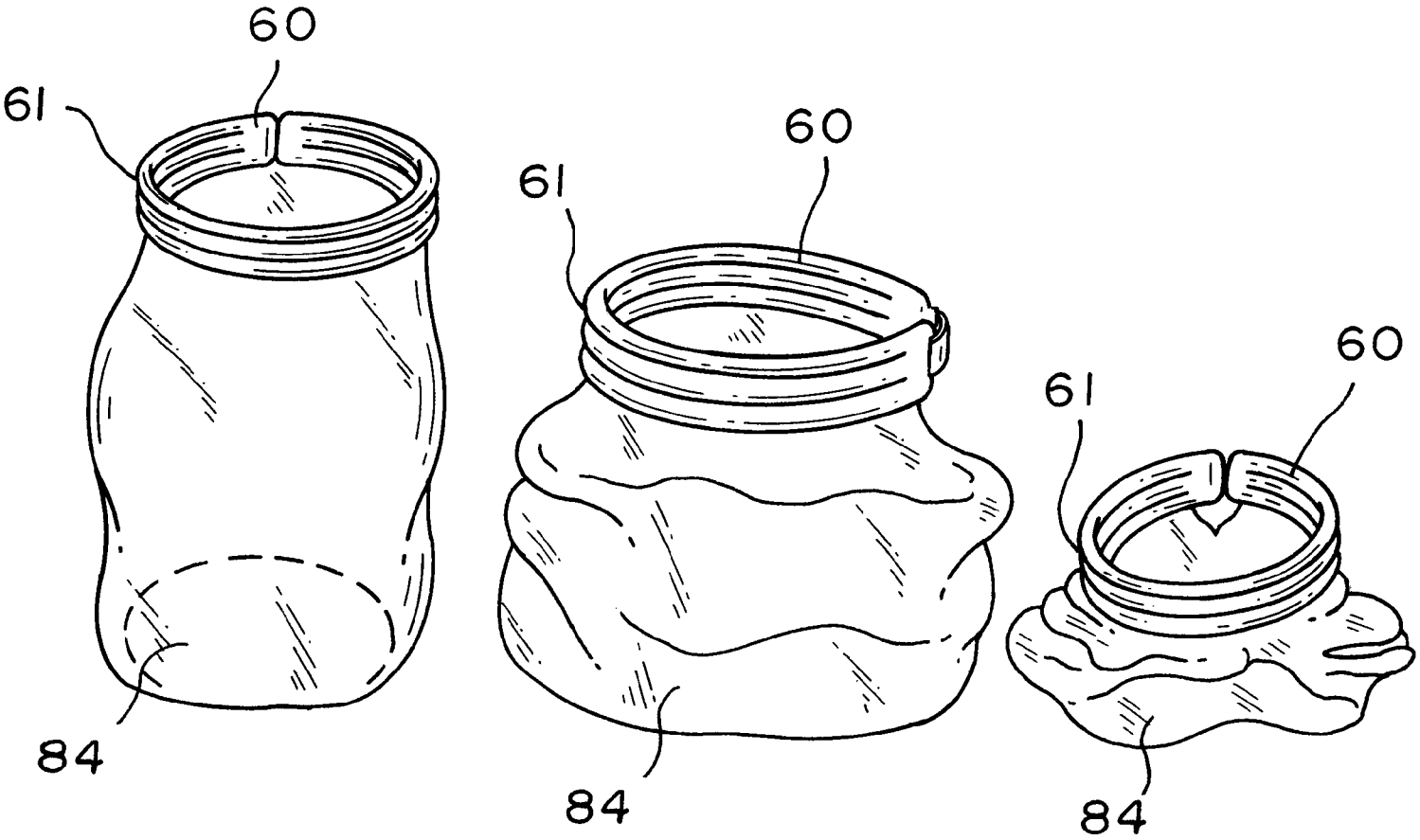
Figure 55:
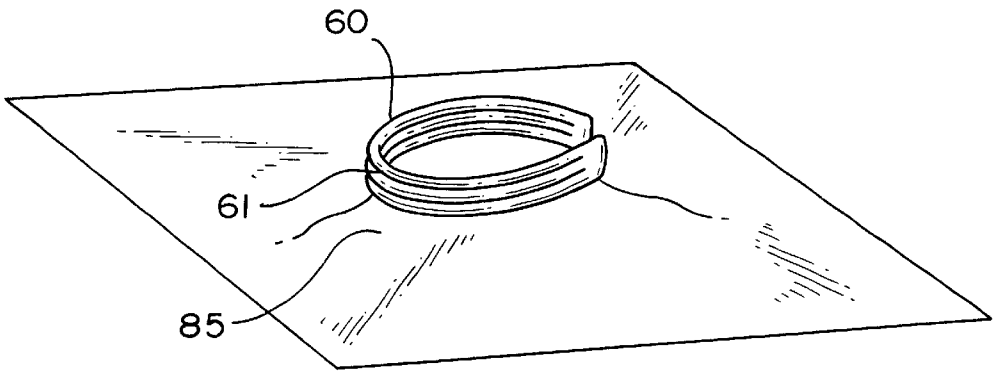
Figure 57:
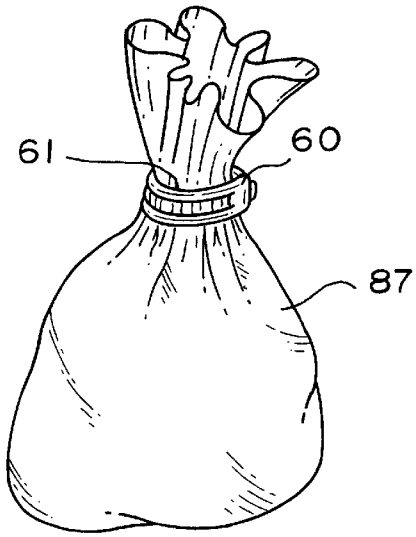
Figure 54:
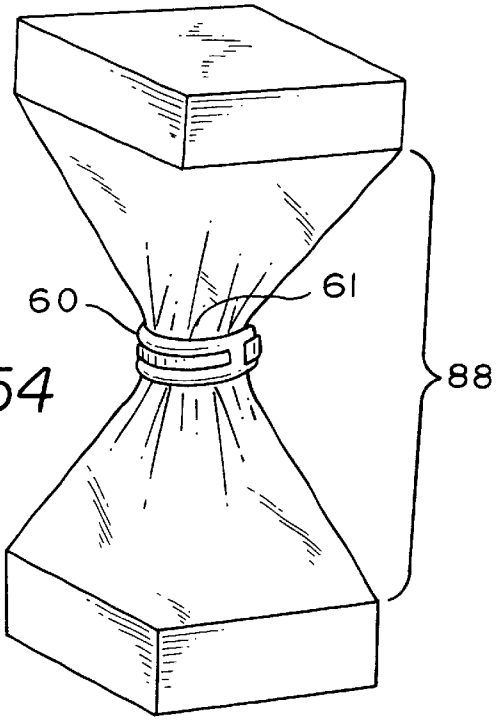
Figure 56:
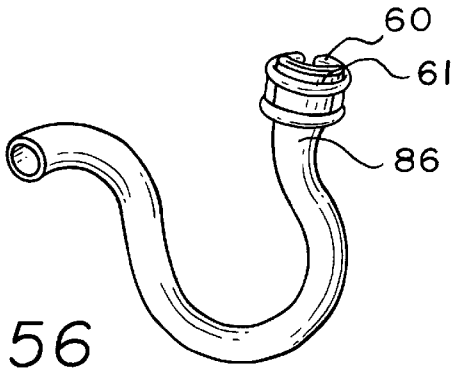
Figure 58B:
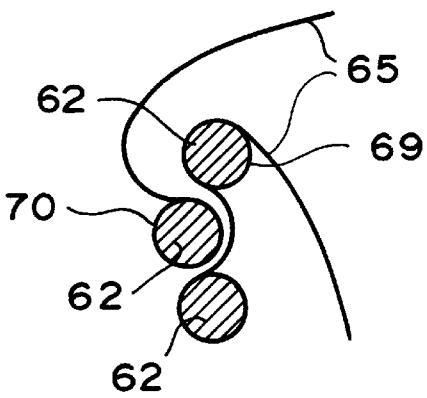
Figure 58A:
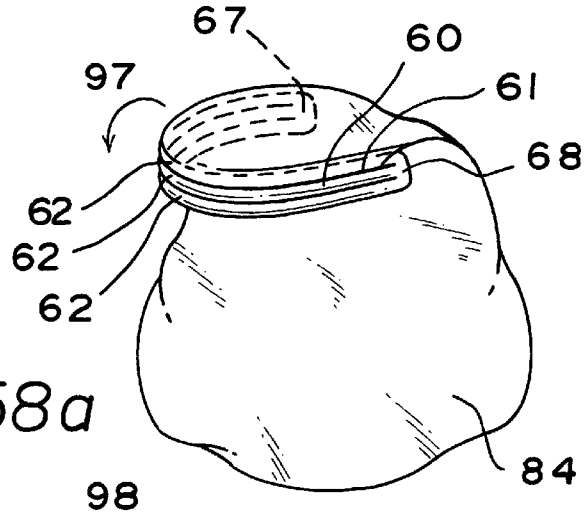

FIG. 38 illustrates a flexible container incorporating the closure of FIG. 2 in a fully open position with a hand inside;

FIG. 39 illustrates a flexible container incorporating the closure of FIG. 2 showing the closure being pivoted to close the partially filled container;

FIG. 40 illustrates a flexible container incorporating the closure of FIG. 2 now fully closed;

FIG. 41 illustrates a flexible container incorporating the closure of FIG. 3 in a fully open position with a hand inside;

FIG. 42 illustrates a flexible container incorporating the closure of FIG. 3 showing the closure being pivoted to close the partially filled container;

FIG. 43 illustrates a flexible container incorporating the closure of FIG. 3 now fully closed;

FIG. 44 illustrates a flexible container surrounded by the closure of FIG. 2 in a fully open position with a hand inside;

FIG. 45 illustrates a flexible container incorporating the closure of FIG. 2 showing the closure being pivoted to close the partially filled container;

FIG. 46 illustrates a flexible container incorporating the closure of FIG. 2 now fully closed;

FIG. 47 is a diagrammatic front perspective view of a container incorporating the closure of either FIG. 2 or FIG. 3;

FIG. 48 is a diagrammatic side perspective view of a container incorporating the closure of either FIG. 2 or FIG. 3;

FIG. 49 is a diagrammatic top perspective view of a container incorporating the closure of either FIG. 2 or FIG. 3;

FIG. 50 is a diagrammatic bottom perspective view of a container incorporating the closure of either FIG. 2 or FIG. 3;

FIG. 51 to 53 illustrate the container of FIG. 47 when fully extended, partially filled and crunched, and fully crunched respectively;

FIG. 54 illustrates a closure of either FIG. 2 or FIG. 3 attached to or surrounding a flexible region of an entity;

FIG. 55 illustrates a closure of either FIG. 2 or FIG. 3 attached to or surrounding a flexible opening in a surface;

FIG. 56 illustrates a closure of either FIG. 2 or FIG. 3 attached to or surrounding a flexible opening in a tube;

FIG. 57 illustrates a closure of either FIG. 2 or FIG. 3 attached to or surrounding a flexible opening in a container;

FIG. 58*a* illustrates a closure of the present invention attached to a flexible opening in a container and rotated forward so that an outer member comes over the top to close the closure like a lip;

FIG. 58*b* is a crosssection of the closure illustrated in FIG. 58*a;*

Figure 59B:
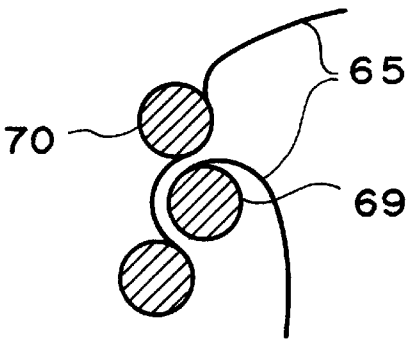
Figure 59A:
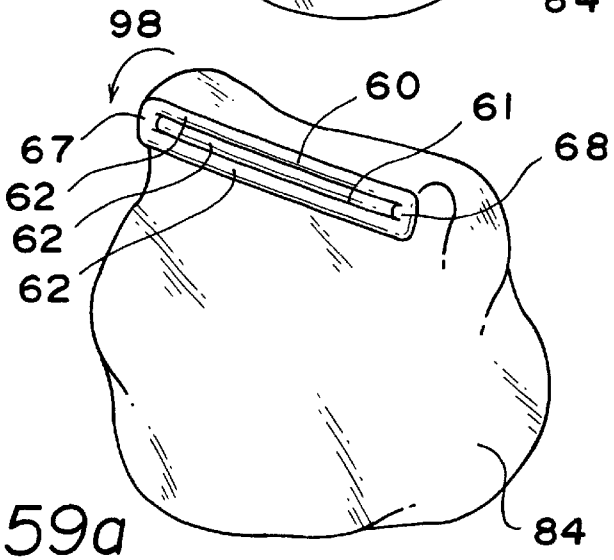

FIG. 59*a* illustrates a closure of the present invention attached to a flexible opening in a container and rotated forward so that the outer member comes over the top to close the closure like a lip;

FIG. 59*b* is a crosssection of the closure illustrated in FIG. 59*a;*

Figure 60A:
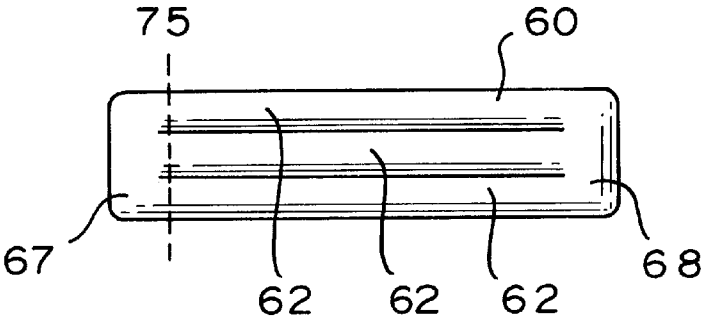
Figure 60B:
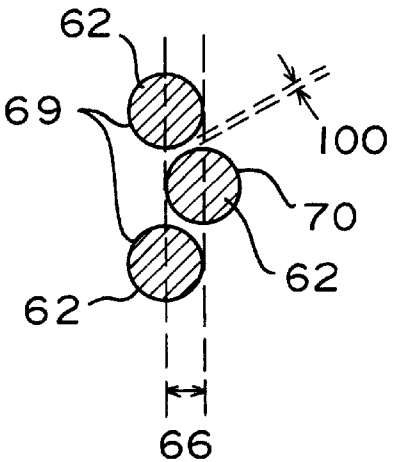

FIG. 60*a* is an illustration of a closure according to the present invention showing a crosssection line near the ends;

FIG. 60*b* is an example crosssection at line 75 of FIG. 60*a;*

Figure 60C:
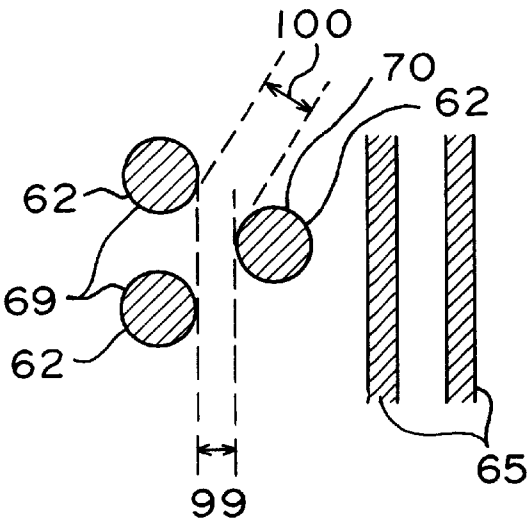

FIG. 60*c* is another example crosssection at line 75 of FIG. 60*a* designed to use a thicker flexible opening material.

Figure 1B:
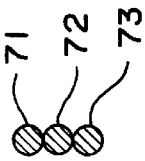
FIG. 1*b* is a crosssection view of the closure of FIG. 1*a* taken on crosssection 75 of FIG. 1*a;*
Figure 1A:
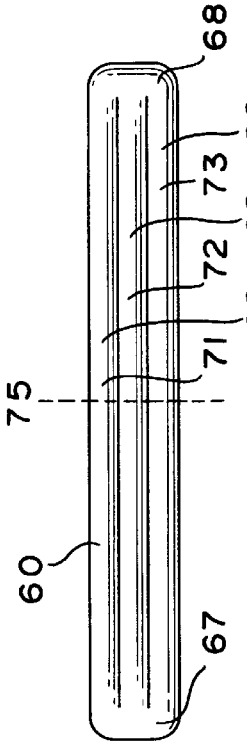
FIG. 1*a* is a front view of a closure according to the invention not in use and without a flexible opening being acted upon.

In the above FIGS. 1*a* to 60*c*, the strip-like elements can be viewed as flexible bar-like portions or flexible stiffening flanges.

DETAILED DESCRIPTION OF THE PREFERRED EMBODIMENTS

A preferred embodiment of the closure of the present invention is illustrated in FIGS. 1 to 4 and 6 with modifications shown in FIGS. 5 and 7 to 37*d*. Functions that the closure can undergo or perform and manners of using this closure and an associated flexible opening or flexible region in a flexible container or other entity such as a surface, tube or sleeve are illustrated in FIGS. 38 to 59*b*.

Closures of the present invention can be separate items for use with flexible openings or may form part of such openings and the entities they are a part of, particularly flexible containers as described in my above U.S. Pat. No. 5,524,990 the complete disclosure of which is hereby incorporated herein by reference.

The closure 60 is comprised of a group of two or more strip-like elements 62. The strip-like elements 62 can be viewed as flexible bar-like portions or flexible stiffening flanges. FIGS. 1*a* to 1*f* are illustrations of a closure 60 with three strip-like elements 62 made up of a top strip-like element 71, a middle strip-like element 72 and a bottom strip-like element 73, attached together by two attaching regions or ends 67 and 68. The strip-like elements 62 are positioned in groups of one or more on alternating sides 69 and 70 of an opening 61 to be closed.

Figure 1C:
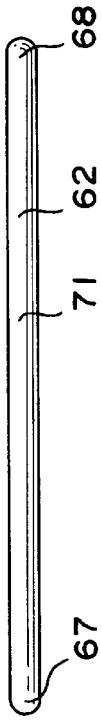
FIG. 1*c* is a top view of the closure of FIG. 1*a;*
Figure 1D:
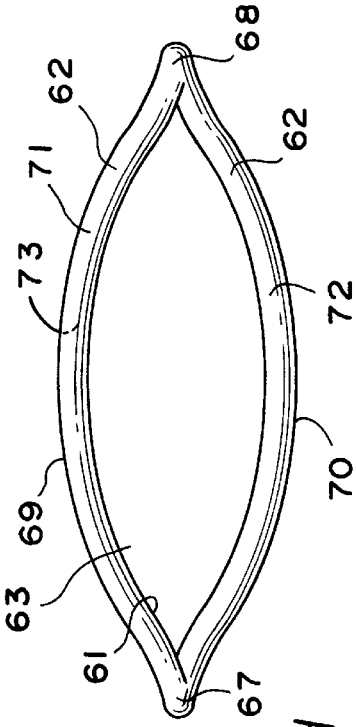
FIG. 1*d* is a top view of the closure of FIG. 1*a* partially open.
Figure 1E:
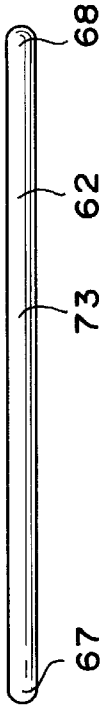
FIG. 1*e* is a bottom view of the closure of FIG. 1 *a;*

FIG. 1*a* is a front view of a closure 60. FIG. 1*b* is a crosssection taken at centerline 75 in FIG. 1*a* showing crosssections of top strip-like element 71, middle strip-like element 72 and bottom strip-like element 73. FIG. 1*c* is a top view showing top strip-like element 71 on the top between ends 67 and 68. FIG. 1*d* is a partially opened closure 60 showing top strip-like element 71 with bottom strip-like element 73 out of view below it on the first side 69, and middle strip-like element 72 on the second side 70, both sides connected at ends 67 and 68.

The strip-like elements 62 area preferably a resilient deformable material that can be bent individually or together. The strip-like elements 62 involved in closing a flexible opening 61 will generally comprise two sets, one on either side 69 and 70 of the opening 61. A set will generally be able to be deformed as a set. In some cases, one of the two sets may be comparatively stiffer than the second set, often meaning that the second set performs some or all of the deformation to open and close the closure 60. If the strip-like elements 62 of the closure 60 are attached to a flexible opening, the connection or connections to the opening will usually require that all strip-like elements 62 on a given side 69 or 70 be able to move as a group.

In FIG. 2*a* top strip-like element 71 and bottom strip-like element 73 and are positioned on the right side 69 of a opening space 63, and strip-like element 72 is on the left opposing side 70. In FIG. 2*b* top strip-like element 71 and bottom strip-like element 73 are pushed towards middle strip-like element 72.

In FIG. 2*b* top strip-like element 71 and bottom strip-like element 73 have been moved towards middle strip-like element 72 and in FIG. 2*c* middle strip-like element 72 nests in between top strip-like element 71 and bottom strip-like element 73. In FIG. 2*b* space 63 is now smaller than FIG. 2*a*.

In FIG. 3*a* top strip-like element 71 and bottom strip-like element 73 are positioned on the right side 69 of a space 63, and middle strip-like element 72 is on the left opposing side 70. In this embodiment of the closure 60, top strip-like element 71 and bottom strip-like element 73 are twisted in the direction of arrow 76 so that when in FIG. 3*b* the right side 69 of the closure 60 is moved in the direction of arrow 77 about hingeline 78 toward the second side 70, they will properly mesh with middle strip-like element 72. In FIGS. 3*b* to 3*c* the twist 76 has been dissipated and middle strip-like element 72 now nests between top strip-like element 71 and middle strip-like element 73. In some cases, the strip-like elements 62 may need to be straightened to some degree to allow the top strip-like element 71 and bottom strip-like element 73 on side 69 and the middle strip-like element 72 on side 70 to properly align with each other before FIG. 3*c* is reached, similar to the illustration in FIGS. 4*b* and 4*c*.

In FIGS. 2*c* and 3*c*, the force holding the closure 60 closed is intensified when ends 67 and 68 are moved progressively closer to each other, bending or curving the lengths of the strip-like elements 62. Strip-like elements 62 on the inner side 69 of the curved shape, here top strip-like element 71 and bottom strip-like element 73, will usually experience some degree of compression, and the strip-like elements 62 on the outer side 70 of the curved shape, here middle strip-like element 72, will usually experience some degree of tension, the combination of this compression and tension creating a tighter closure 60.

In FIG. 4*a* top strip-like element 71 and bottom strip-like element 73 are positioned on the right side 69 of a space 63, and middle strip-like element 72 is on the left opposing side 70. In this embodiment of the closure 60, top strip-like element 71 and bottom strip-like element 73 is pushed towards middle strip-like element 72 while middle strip-like element 72 is pushed towards top strip-like element 71 and bottom strip-like element 73. In FIG. 4*b* the closure 60 is progressively more closed by moving side 70 including top strip-like element 71 and bottom strip-like element 73 in the direction of arrow 79 and moving side 69 including middle strip-like element 72 in the direction of arrow 80. In this example, the strip-like elements 62 are straightened to a degree to allow top strip-like element 71 and bottom strip-like element 73 on side 69 to align with middle strip-like element 72 on side 70 before FIG. 4*c* is reached.

In FIGS. 2*b* and 3*b* one side 69 of the closure 60 is moved toward the other side 70 and in FIG. 4*b* the two sides 69 and 70 are moved toward each other. In most cases this is done by a person's hand moving them in these directions.

In FIGS. 5 to 9 other closures 60 according to the present invention are shown with various numbers of strip-like elements 62.

FIGS. 10*a* to 13*b* illustrate other embodiments of the closure 60 of the present invention, showing variations in the size and shape of the strip-like elements 62 and the closure 60 as a whole. For clarity of image, the crosssections of the material of the material of the flexible opening 65 is shown unattached to the strip-like elements 62. It may also be attached or partially attached. FIGS. 10*b*, 11*b*, 12*b*, and 13*b* are crosssection views taken at line 75 in FIGS. 10*a*, 11*a*, 12*a*, and 13*a*. FIG. 12*b* and 12*c* show examples of how strip-like elements 62 may be located in different locations around a flexible opening. FIG. 12*c* shows groups of one alternately placed on one side then the other side of the flexible opening material 65. 12*b* shows a number of groups of one and a group of two made up of the second and third strip-like elements from the top.

Although the flexible opening material 65 appears in FIGS. 10*b*, 11*b*, 12*b*, 12*c*, and 13*b* and other drawings to be very thin, the thickness of a single line, this is not always the case. It is drawn as a single line for simplicity in the drawing. The flexible opening material 65 may be thicker.

During the closing of the closure 60 according to this invention, there are usually two events that occur. The first is the sides 69 and 70 of the closure 60 coming together and usually creating a seal. Secondly the closure 60 is by some method held in the closed and usually sealed position.

FIGS. 14*a* to 14*c* are crosssectional views of a set of closures taken at a point equidistant from the two ends of the closures. In FIGS. 14*b* and 14*c* illustrate two examples of methods of redesigning the closure in FIG. 14*a* to create a tighter seal. In FIG. 14*b* the flexible opening 65 material has been made more taut between two strip-like elements, here top strip-like element 71 and bottom strip-like element 73, from one of the sides 69 so that it can press back against a strip-like element, or strip-like element and opening material, here middle strip-like element 72 and opening material 65, from the opposing side 70 that lines up between top strip-like element 71 and bottom strip-like element 73 on the first side 69. In other words, the taut opening material 65 between top strip-like element 71 and bottom strip-like element 73 prevents the middle strip-like element 72, or the middle strip-like element 72 and opening material 65, from coming towards the taut opening material 65 from the opposite side 69 from moving as far as the middle strip-like element 72 wants to move once a force is applied to hold the closure 60 closed. Another method is where as illustrated in FIG. 14*c* one or more of the strip-like elements, in this example top strip-like element 71 and bottom strip-like element 73, on one side 69 create an overlap 66 vertically to some degree with one or more strip-like elements on the other side 70, here middle strip-like element 72, again preventing the crosspiece 72 from moving as far as it wants. In most cases, in addition to not being able to move as far as it wants, crosspiece 72 by default in return may prevent crosspieces 71 and 73 from moving as far as they want to. Crosspiece 72 may also be part of a set with another crosspiece or crosspieces that create such situations as overlaps and taut flexible opening material that may press back against crosspieces 71 and 73.

FIG. 14*a* to 14*c* show the flexible opening material 65 attached to the strip-like elements. It is also possible to have the material 65 partially attached or unattached. The flexible opening material 65 tautness for example could be attained with the flexible opening material 65 unattached by using a material for the strip-like elements whose surface properties do not permit the flexible opening material 65 to slip. The overlap 66 between side 69 made up of top strip-like element 71 and bottom strip-like element 73 and side 70 made up of middle strip-like element 72 long can be attained through strip-like element design details such as stiffness, size, placement, or an attachment between strip-like elements on a specific side at a location other than the ends of the strip-like elements. The flexible opening material 65 is shown in FIGS. 14*a* to 14*c* the thickness of a single line for simplicity. It may be thicker.

FIGS. 15*a* to 17*c* illustrate examples of how the resting shape of a closure 60 and or manufactured shape may differ from that which appears in FIG. 1*a* to 1*c*. FIGS. 15*c*, 16*c*, and 17*c* are crosssection views of the closures 60 in FIGS. 15*a*, 16*a*, and 17*a* taken at a location equidistant from the two ends 67 and 68 of the closures 60. Top strip-like element 71 and bottom strip-like element 73 are in a resting position a distance away from middle strip-like element 72.

FIGS. 18*a* to 20*b* illustrate closures 60 according to the present invention that may close more than one flexible opening visible here by the flexible opening crosssections 65 where two crosssections of material 65 make up a flexible opening. FIGS. 18*b*, 19*b*, and 20*b* are crosssection views of the closures 60 in FIGS. 18*a*, 19*a*, and 20*a* taken at a location equidistant from the two ends 67 and 68 of the closures 60. For clarity of image, the crosssections of the material of the flexible opening 65 is shown detached from the strip-like elements 62. It may also be attached or partially attached. FIGS. 18*a* to 20*b* illustrate closures 60 that are formed in a three dimensional form, where the strip-like elements 62 are lined up not only vertically, but horizontally as well. FIG. 20*a* illustrates a closure 60 that not only closes multiple flexible openings, but additionally closes two flexible openings, visible here by the flexible opening crosssections 65 where two crosssections make up a flexible opening, within a single route in a closure 60.

Although the crosssection shown in FIGS. 1*b*, 10*b*, 11*b*, 12*b*, 12*c*, 14*a*, 14*b*, 14*c*, 18*b*, 19*b*, 20*b*, 21*b*, and 22*b* makes the strip-like element crosssections labeled 62, 71, 72, and 73 appear to be thicker than the opening material 65, this is not necessarily always the case.

FIGS. 21*a* to 22*b* are illustrations of strip-like elements that are either made up of or blended into the material of the opening. FIGS. 21*b* and 22*b* are crosssection views of the closures 60 in FIGS. 21*a* and 22*a* taken at a location equidistant from the two ends 67 and 68 of the closures 60. Strip-like elements 71 and 73 are made up of material tension 77 functioning as those strip-like elements 71 and 73 would have.

The strip-like element or strip-like elements 77 on one side 69 may be blended into or made up of the material of the flexible opening 65 of the corresponding side 69 of the flexible opening instead of actually appearing themselves. In this case the one side 69 of the flexible opening being closed acts as and performs the same functions as a strip-like element or strip-like elements 77. The sides 69 and 70 are pushed together or alternately the side 70 with one or more strip-like elements 62 may be stiffer and the side 69 where the material of the flexible opening 65 may perform most of the movement for the two sides 69 and 70 to close. The sides 69 and 70 mesh and are forced together by bending or curving of the closure 60 so that the side 70 with one or more strip-like elements 62 is on the inside of the curved shape, and may be holding some degree of compression, and the side 69 where the flexible opening material 65 acts as one or more strip-like elements 77 is on the outside of the curve holding tension.

FIGS. 23 to 26 illustrate a series of closures 60 being tightened by bending or curving of the closure 60. In these drawings, the closure 60 appears as a single form from the top view. In other instances, strip-like elements 62 from both sides 69 and 70 may be visible from the top view. The amount of bending chosen depends on such issues as the stiffness and flexibility of the closure 60 or some part or region of a flexible opening, the degree of force holding the closure 60 closed desired, and how the closure 60 will be held in the chosen curved position. The ends of the closure 67 and 68 may or may not meet in bending the closure 60 to the closed position.

In closures that are curved to enhance the tightness of the closure, it must be noted that it is not always the right side pushed towards the left side, nor is it the side with more strip-like elements that is pushed towards the side with less strip-like elements. It is a usage consideration for the individual closure which strip-like elements appear on which side, whether the closure is closed straight or bent, and what is to be the outside of the curved shape and what is to be the inside of the curved shape if the closure is bent. A closure that curves to enhance tightness may also be designed wherein either side may become the inside and either side may become the outside of the closure.

To hold a closure sealed, there is most commonly a force within one or more strip-like elements, a force external to the closure, or some combination such as a combination of internal and external forces. There is sometimes a method of connecting or holding that is applied after the force to hold the seal is in existence, holding it in position in addition to holding it together.

There may be a force external to a closure 60 that becomes a curved closure 60 such as where the curve has created tension in one side 69 or 70 and/or compression in the other side 69 or 70, to keep the closure 60 in a curved position once it has been placed in the curved position such as by two hands bending it to the curved position. If the closure 60 is closed and held sealed by curving the closure 60, it may also be held in place by attaching the two ends 67 and 68 together by such means as clipping 90 illustrated in FIG. 27, buttoning 91 illustrated in FIG. 28, tying 92 illustrated in FIG. 29, snapping 93 illustrated in FIG. 30, and latching 94 illustrated in FIG. 31. The closure 60 may be held in a curved position by a frame 95 or 96 holding the closure 60 in place as illustrated in FIG. 32 by frame 95 and in FIG. 33 by frame 96.

There may be a force external to the closure 60, strip-like elements 62 or sides 69 and 70 on a straight closure 60 or closure 60 with sides 69 and 70 pressed together in any other position, such as a clip 89 applied to the outside edge of the sides 69 and 70 as illustrated in FIG. 34*a* and 34*b*. FIG. 34*b* is a crosssection view of the closure 60 and clip 89 in FIG. 34*a* taken at a location equidistant from the two ends 67 and 68 of the closure 60.

There may be a force within one or more strip-like elements 62 of a closure 60 that is closed in a straight position as illustrated in FIG. 35 or a closure 60 whose sides 69 and 70 are pressed together and placed in any position other than straight while those sides 69 and 70 are in contact. Examples of closures 60 that can be held closed in a straight position include a closure with an area within two or more strip-like elements 62 that causes one side 69 to try to curve into the other side 70 while the second side 70 with a stronger preference tries and succeeds in staying straight. Another example is where both sides 69 and 70 are trying to curve into the opposing sides 70 and 69 thereby offsetting each other so that neither attains the curved shape that it is attempting because they are attached at the ends 67 and 68 and cancel each other out, creating a straight closure closed.

There may be a force within a closure 60 that becomes curved, for example where that curving or bending has created tension in one side 70 and/or compression in the other side 69. Two examples of this include areas within one or more strip-like elements 62 that want to be in a curved position, and two ends 67 and 68 that have magnets inside that attract each other. In these cases, the closure 60 may move to the curved position itself once the two sides 69 and 70 have been moved into a position against each other, or it may be placed in the curved position such as by two hands bending it into the curved position.

FIGS. 37*a* to 37*d* show a closure 60 material with inherent stresses in the material such as certain thin metal formations that may have multiple resting positions. FIG. 37*a* shows the first stable position, curved widthwise in the direction of the curve of arrow 81, FIG. 37*b* shows the closure moving towards the second stable position, and 37*c* shows the second stable position, with strip-like elements 62 curled lengthwise in the direction of the curve of arrow 82. FIG. 37*d* is a crosssection of the closure 60 in FIG. 37*a* taken at a location equidistant from the two ends 67 and 68 of the closure 60.

FIGS. 38 to 59*b* show what a closure 60 looks like surrounding or attached to a flexible opening 61 of a flexible container 84 or other entity such as a surface 85, tube 86 or other flexible region 88 are illustrated in FIGS. 38 to 59*b*.

FIGS. 51, 52 and 53 show how a closure 60 when attached to a readily deformable flexible container 84, permits the flexible container 84 to be deformable or easily adaptable in size while the closure 60 typically remains the similar to its original shape.

As illustrated in FIGS. 58*a* to 59*b*, the closure 60 may be flipped or twisted in the direction of arrows 97 and 98 including the strip-like elements 62 and flexible opening material 65 of a flexible container 84 so that sides 69 and 70 are rolled over each other. FIGS. 58*b* and 59*b* are crosssection views of the closures 60 in FIGS. 58*a* and 59*a* taken at a location equidistant from the two ends 67 and 68 of the closures 60. In some cases this may serve such purposes as creating an opening 61 where remnants of the contents is less likely to become caught in the closure 60 after pouring.

FIGS. 60*b* and 60*c* are crosssections taken immediately following the location at which the strip-like elements 62 are attached to the two ends 67 and 68, shown in FIG. 60*a* by line 75. It is usually important that the closure closes tightly at this location at each of the ends, since the flexible opening material 65 frequently flips over or folds on itself in this corner area. To make sure that this fold area of the flexible opening material 65 may be securely sealed, the two corner areas, one at each of the ends 67 and 68 of the closure 60, often become among most technically important.

In the most general terms, what is usually desired is an area where portions of the two opposing sides press into each other with some force at the corner area where the strip-like elements 62 and ends 67 and 68 come together. Usually the closure itself will govern at least in part the forces holding the corners tight. Some of this force is often inherent in this corner area within the closure 60 itself instead of relying on the force that holds the closure 60 closed. The corner areas may even stay comparatively tight even as the closure 60 is opened. If the area does remain comparatively tight when the closure 60 is opened, it is generally desired that the area be capable of being untightened using the force of two hands manipulating the strip-like elements 62 from the two opposing sides 69 and 70 of the closure 60 so that the region may be cleaned.

If a thin flexible opening material 65 is secured taut between two strip-like elements 62, for example the strip-like elements 62 illustrated in FIGS. 60*b* located on side 69, the overlap 66 between sides 69 and 70 in FIG. 60*b* shows the area that the strip-like element 62 on sides 69 and 70 will usually be trying to move towards. When the thin flexible opening material 65 is not held taut between any two strip-like elements 62 on either of the sides, the more important distance is usually the distance between the closest two points 100 on two strip-like elements 62 on two opposing sides 69 and 70, since the flexible opening material 65 will usually tend to move in a weaving motion around each of the strip-like elements 62 if it is not held taut. With strip-like elements 62 that have a tendency to move in a vertical fashion, it is sometimes necessary to average the distance between one strip-like element 62 on one side 70 and the strip-like elements immediately above it and below it on the other side 69.

When the flexible opening material 65 is thick, such as is illustrated in FIG. 60*c*, where the flexible opening material 65 has been drawn outside the strip-like elements 62 for clarity, the strip-like elements 62 may not themselves appear to overlap, yet may still perform the same functions as above. If the thick flexible opening material 65 is held taut, the more important distance is usually the separation between sides 99. If the thick flexible opening material 65 is not held taut between any two strip-like elements 62 on either side 69 or 70, the more important distance will usually be the distance between the closest two points 100 on two strip-like elements 62 from opposing sides, since the flexible material 65 will usually tend to move in a weaving motion around each of the strip-like elements 62 if it is not held taut.

It is apparent in FIG. 60*b* that if the thin material of the flexible opening 65 is held taut between the two strip-like elements 62 of side 69 that the strip-like element 62 from the opposing side 70 will be inclined to press against it since its natural position is the distance of overlap 66 in from the edges of the strip-like elements 62 of side 69. If the material 65 is not held taut, the distance between the closest two points 100 on two strip-like elements 62 from opposing sides is usually compared to the thickness of two layers of the thin flexible opening material 65 to see if it the strip-like elements 62 on opposing sides 69 and 70 will be inclined to press against each other. Whether or not the closure closes tightly enough will depend on many factors, including the stiffness, flexibility and elasticity of both the closure 60 and the flexible opening material 65. The overlap 66, for example, may need to be enlarged or the distance between points 100 may need to be shrunken to reach a desired closure tightness.

Similar to this description of FIG. 60*b*, FIG. 60*c* shows a closure designed for a thicker flexible opening material 65. Instead of an overlap 66 noted in the situation where the thick flexible opening material 65 is held taut between two strip-like elements 62 on a side, here side 69, the space between the sides 99 is noted. Like 60*b*, if the thick flexible opening material 65 is not held taut, the more important distance is usually be the distance between the closest two points 100 on two strip-like elements 62 from opposing sides 69 and 70. In these cases, the thickness of two layers of the thick flexible opening material is compared either to the distance between sides 99 or the distance between points 100 on strip-like elements 62 to determine if the opposing sides 69 and 70 will be inclined to press against each other. Again, whether or not the closure 60 closes tightly enough will depend on many factors, including the stiffness, flexibility and elasticity of both the closure 60 and the flexible opening material 65. The distance between sides 99 or the distance between points 100, for example, may need to be shrunken to reach the desired closure tightness.

The description above may be incomplete for more complex situations such as strip-like elements that are not oriented in a straight fashion, closures that are curve to close, closures that are closed due to pressure from unusual forces or in unusual locations, closures with strip-like elements of differing lengths and thicknesses, the stiffness, flexibility and elasticity of the flexible opening, closure or parts of either, the number of strip-like elements, the setup or order of the strip-like elements and the range of vertical and horizontal movement permitted in the strip-like elements.

It may at times be desirable to maintain a closure in a formation where strip-like elements do not become flush with those of the opposing side so that there is a specific and possibly limited area to take up any force or forces placed on the closure from the outer edge to hold the closure closed.

Areas to note in a crosssection when closing a closure are similar for the rest of the closure beyond the corner area, but often rely more on other forces for the ability to hold the two sides together.

Strip-like elements may in cases be differing in lengths, for example for differing tightnesses of the closure, for differing opening material thickness or stiffness, for differing closure material thickness or stiffness, or for areas of the closure that close differing numbers of openings. More than one flexible opening may be closed by a single flexible closure opening.

A significant part of the ability of the closure to function comes from the flexibility of the closure in the region near but not entirely at the corner area of the closure. This is most commonly the area most of its movement occurs during opening and closing instead of strictly on at the connection area at the corner.

There may be any number of strip-like elements equal to or greater than two, in other words a plurality of strip-like elements.

The strip-like elements may be of differing shapes and may be made in 2 dimensional, 3 dimensional and complex shapes.

The preferred embodiment of the present invention is a reusable product, although it may be a disposable product.

A flexible opening could either be attached in or placed in a space inside the closure or could be attached to the outside of the closure. If the flexible opening is attached to the outside of the closure, the attachment between the flexible opening and the closure must be continuous around each end and continue the full length of at least one strip-like element on each side of the opening to where it attaches continuously at each end to be able to seal the closure.

How tight the closure is can be affected by factors such as the lengths of one or more strip-like elements, the widths of one or more strip-like elements, the stiffness and flexibility of the closure or parts or regions of the closure, the stiffness and flexibility of the flexible opening or parts or regions of the flexible opening.

It must be noted that although this closure is seen as a flexible closure, it may be made up in part of nonflexible regions. Regions of one or more strip-like elements and or regions of one or more groups on a particular side of an opening may be stiffened. An entire side of the closure may also be stiff, although for both sides of the closure to be stiff there will typically be a small region near the connecting regions 90 and 91 will be flexible. Associated with these nonflexible regions of the closure may be nonflexible regions of the opening to be closed. The connecting region ends 90 and 91 may be flexible or non flexible.

The connecting region ends may be integral with the strip-like elements or may be an additional part attached to the strip-like elements. The strip-like elements may be of differing material makeup than the connecting region ends, may be of differing material makeup than each other, and may differ within one or more of themselves. Additionally strip-like elements may have other differing properties such as shape, thickness, form of attachment or lack thereof to the opening.

In another embodiment of the closure of the present invention a portion of a closure may be kept open when the closure is closed to permit a region for such uses as a pour spout or a hole for a straw.

When there is no attachment between the closure and a flexible opening material, to create a seal there is often one or more regions where strip-like elements from alternate sides overlap to some degree vertically, such as due to their sizes, placement, by connecting two or more on one side together at one or more locations besides their ends, or the closure may be made of a material whose surface properties do not allow the flexible opening material to slip against the strip-like elements it lays against.

The closure may be made as all one piece or as multiple pieces that are attached together. If it is multiple pieces, they may be the same or differing materials. If it is multiple pieces the pieces may be attached by such means as gluing, riveting, an extension from one piece that fits into or onto another piece, and pieces themselves fitting into other pieces. The closure as a whole, parts that make up a closure, or a closure that is formed as an integral part of another entity may be manufactured by such means as cutting, injection molding, blow molding, rotomolding poured molding, casting, and machining.

The closure may be made of such materials as polyurethane, vinyl, polypropylene, ethylene vinyl acetate, a flexible metal such as thin cut sheet or wire, or a cast nonwoven material.

The above described embodiments, of course, are not to be construed as limiting the breadth of the present invention. Modifications, and other alternative constructions, will be apparent which are within the spirit and scope of the invention as defined in the appended claims.

I claim:

1. A flexible closure capable of closing a flexible opening, comprising:

at least two strip-like elements having ends;

said strip-like elements being oriented in a parallel series;

said strip-like elements being attached together at said ends;

said strip-like elements being alternately deformed in groups of at least one to one side then to the other side of said flexible opening to be closed;

said groups of strip-like elements forming two sets, one of said sets on each of two sides of an area to be closed; and said two sets being positioned away from each other when said area to be closed is open, and positioned against each other when said area to be closed is closed.

2. The closure of claim 1, wherein said closure is all one piece.

3. The closure of claim 1, wherein said closure is permanently attached to said flexible opening.

4. The closure of claim 1, wherein said closure is removably attached to said flexible opening.

5. The closure of claim 1, wherein said closure is placed around said flexible opening.

6. The closure of claim 1, wherein said closure is incorporated into said flexible opening.

7. The closure of claim 1, wherein a section of said flexible opening to be closed is kept open while the remainder of said flexible opening is closed.

8. The closure of claim 1, wherein more than one of said flexible openings is closed by said closure.

9. The closure of claim 8, wherein said strip-like elements are lined up both vertically and horizontally to form a three dimensional structure.

10. A flexible closure comprising:

a series of at least two flexible stiffening flanges;

said flexible stiffening flanges being lined up like rungs on a ladder;

said rung-like flexible stiffening flanges being attached at two ends by two attachment regions;

said attachment regions being perpendicular to said rung-like flexible stiffening flanges, and appearing like sides of a ladder that support rungs of a ladder;

said rung-like flexible stiffening flanges and said attachment regions forming a ladder-like structure;

said ladder-like structure being oriented in a vertical manner and said rung-like flexible stiffening flanges moving horizontally in groups of at least one away from the centerline of said ladder-like structure to form an opening;

said groups of rung-like flexible stiffening flanges forming two sets on opposing sides of said opening; and said sets of groups of rung-like flexible stiffening flanges moving towards each other to close the closure.

11. The closure of claim 10, wherein said opposing sides are held together by an internal force within at least one of said flexible stiffening flanges.

12. A container that incorporates the closure of claim 10.

13. The closure of claim 10, wherein said two sets on said opposing sides are held together by an external force pressing from the outside of said opposing sides.

14. The closure of claim 13, wherein the means by which said closure is held closed is separate from said closure.

15. The closure of claim 10, wherein the force holding said two sets on said opposing sides together is created by the closure being deformed and held in a curved manner.

16. The closure of claim 15, wherein said closure is maintained in a curved manner by a releasably attached attachment connecting said two ends.

17. The closure of claim 15, wherein said flexible stiffening flanges on the outer of said two sides when said closure is being deformed and held in a curved manner are made up of the material comprising a flexible opening being closed.

18. The closure of claim 10, wherein at least two of said flexible stiffening flanges, at least one of said two flexible stiffening flanges being from each of said two sets, overlap in a vertical manner.

19. A closure comprising:

a series of at least two flexible bar-like portions;

said flexible bar-like portions being oriented in groups of at least one to one side then to the other side of an opening between them;

said groups comprising two sides of said opening, said opening being oval, circular or eye shaped when opened, said two sides moving towards each other as said opening closes;

said flexible bar-like portions having ends connected together and comprising a hingeline having two corners that coincide with said ends of said flexible bar-like portions making up said groups comprising said two sides of said opening; and said sides nesting against each other when said closure is closed.

20. The closure of claim 19, wherein at least one of said flexible bar-like portions possesses at least one region that is stiffened.

* * * * *